US009733613B2

(12) United States Patent
Sato

(10) Patent No.: US 9,733,613 B2
(45) Date of Patent: Aug. 15, 2017

(54) IMAGE FORMING APPARATUS HAVING EXPOSURE UNIT AND PROCESS CARTRIDGE

(71) Applicant: Brother Kogyo Kabushiki Kaisha, Nagoya-shi, Aichi-ken (JP)

(72) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/016,581

(22) Filed: Feb. 5, 2016

(65) Prior Publication Data

US 2016/0231696 A1 Aug. 11, 2016

(30) Foreign Application Priority Data

Feb. 6, 2015 (JP) ..... 2015-022596

(51) Int. Cl.
*G03G 21/16* (2006.01)
*G03G 21/18* (2006.01)

(52) U.S. Cl.
CPC . *G03G 21/1842* (2013.01); *G03G 2215/0132* (2013.01); *G03G 2221/1684* (2013.01)

(58) Field of Classification Search
USPC ..... 399/107, 110–114, 297–303, 308
See application file for complete search history.

(56) References Cited

U.S. PATENT DOCUMENTS 6,587,660 B2 7/2003 Ueno et al.
7,486,907 B2 2/2009 Noguchi et al.
7,660,549 B2 2/2010 Noguchi et al.
7,664,428 B2 2/2010 Kei
7,684,728 B2 3/2010 Okabe et al.
8,145,095 B2 3/2012 Sakurai et al.
8,358,952 B2 1/2013 Okabe
(Continued)

FOREIGN PATENT DOCUMENTS

JP S63-8653 A 1/1988
JP H09-304994 A 11/1997
(Continued)

OTHER PUBLICATIONS

Feb. 5, 2016—Co-pending U.S. Appl. No. 15/016,616.
(Continued)

*Primary Examiner* — Hoan Tran
(74) *Attorney, Agent, or Firm* — Banner & Witcoff, Ltd.

(57) ABSTRACT

In an image forming apparatus, a belt unit, a process cartridge, and an exposure unit are arranged in this order in a first direction such that the belt unit is positioned at an upstream side of the process cartridge in the first direction and the exposure unit is positioned at a downstream side of the process cartridge in the first direction. The photosensitive drum is engaged to a positioning member from an upstream side of the positioning member in the first direction. A pressing member presses the process cartridge from the upstream side toward the downstream side of the process cartridge in the first direction. The pressing member moves between a first position, at which the pressing member presses the process cartridge, and a second position, at which pressing of the pressing member to the process cartridge is released.

22 Claims, 14 Drawing Sheets

(56) References Cited

U.S. PATENT DOCUMENTS

| | | | | |
|---|---|---|---|---|
| 8,712,282 | B2 * | 4/2014 | Sato | G03G 21/1619 399/110 |
| 8,768,206 | B2 | 7/2014 | Sato | |
| 8,792,805 | B2 | 7/2014 | Takayama | |
| 8,855,530 | B2 | 10/2014 | Sato | |
| 8,862,022 | B2 | 10/2014 | Sato et al. | |
| 8,892,002 | B2 | 11/2014 | Sato | |
| 8,929,770 | B2 | 1/2015 | Sato | |
| 8,948,656 | B2 * | 2/2015 | Nakano | G03G 21/1628 399/125 |
| 9,037,036 | B2 | 5/2015 | Yamashita et al. | |
| 9,052,688 | B2 | 6/2015 | Sekido | |
| 9,134,686 | B2 | 9/2015 | Yoshikawa et al. | |
| 9,134,695 | B2 | 9/2015 | Furukawa et al. | |
| 9,146,492 | B2 | 9/2015 | Suzuki | |
| 2007/0077087 | A1 | 4/2007 | Okabe et al. | |
| 2007/0160385 | A1 | 7/2007 | Noguchi et al. | |
| 2009/0047039 | A1 | 2/2009 | Noguchi et al. | |
| 2009/0092412 | A1 | 4/2009 | Kei | |
| 2009/0116869 | A1 * | 5/2009 | Kotsuka | G03G 21/185 399/111 |
| 2009/0290903 | A1 * | 11/2009 | Horikawa | G03G 21/185 399/111 |
| 2009/0290904 | A1 * | 11/2009 | Kawai | G03G 21/1842 399/111 |
| 2009/0290905 | A1 * | 11/2009 | Mizuno | G03G 21/1842 399/111 |
| 2009/0324275 | A1 | 12/2009 | Okabe | |
| 2010/0080619 | A1 | 4/2010 | Kawanami | |
| 2010/0080623 | A1 | 4/2010 | Tanaka et al. | |
| 2010/0239314 | A1 | 9/2010 | Takayama | |
| 2012/0057900 | A1 | 3/2012 | Okabe | |
| 2012/0114374 | A1 | 5/2012 | Suzuki | |
| 2012/0328325 | A1 | 12/2012 | Sato | |
| 2012/0328326 | A1 | 12/2012 | Sato | |
| 2012/0328327 | A1 | 12/2012 | Sato | |
| 2013/0108316 | A1 | 5/2013 | Sato et al. | |
| 2013/0308976 | A1 | 11/2013 | Sekido | |
| 2013/0315619 | A1 | 11/2013 | Shuhama et al. | |
| 2014/0064782 | A1 | 3/2014 | Furukawa et al. | |
| 2014/0137372 | A1 | 5/2014 | Yamashita et al. | |
| 2014/0147158 | A1 | 5/2014 | Fujinaka et al. | |
| 2014/0186082 | A1 | 7/2014 | Yoshikawa et al. | |
| 2014/0210929 | A1 | 7/2014 | Suzuki | |
| 2014/0241749 | A1 | 8/2014 | Okabe | |
| 2014/0294438 | A1 | 10/2014 | Okabe | |
| 2014/0314446 | A1 | 10/2014 | Sato | |
| 2015/0010325 | A1 | 1/2015 | Sato et al. | |
| 2015/0023691 | A1 | 1/2015 | Sato | |
| 2015/0071681 | A1 | 3/2015 | Sato | |
| 2015/0110523 | A1 | 4/2015 | Sato | |
| 2015/0227110 | A1 | 8/2015 | Yoshimura et al. | |
| 2016/0026151 | A1 | 1/2016 | Sato et al. | |

FOREIGN PATENT DOCUMENTS

| | | | |
|---|---|---|---|
| JP | H11-344905 | A | 12/1999 |
| JP | 2001-337580 | A | 12/2001 |
| JP | 2004-177443 | A | 6/2004 |
| JP | 2007-101635 | A | 4/2007 |
| JP | 2009-092914 | | 4/2009 |
| JP | 2010-008724 | A | 1/2010 |
| JP | 2010-117731 | A | 5/2010 |
| JP | 2010-217813 | A | 9/2010 |
| JP | 2011-059730 | A | 3/2011 |
| JP | 2011-070142 | A | 4/2011 |
| JP | 2013-007946 | A | 1/2013 |
| JP | 2013-007947 | A | 1/2013 |
| JP | 2013-007948 | A | 1/2013 |
| JP | 2013-097185 | A | 5/2013 |
| JP | 2013-242439 | a | 12/2013 |
| JP | 2013-246366 | A | 12/2013 |
| JP | 2014-067005 | A | 4/2014 |
| JP | 2014-067010 | A | 4/2014 |
| JP | 2014-106392 | A | 6/2014 |
| JP | 2014-106393 | A | 6/2014 |
| JP | 2014-123107 | A | 7/2014 |
| JP | 2014-126842 | A | 7/2014 |
| WO | 2014038725 | A1 | 3/2014 |

OTHER PUBLICATIONS

Feb. 5, 2016—Co-pending U.S. Appl. No. 15/016,646.
Feb. 4, 2016—Co-pending U.S. Appl. No. 15/015,788.
Feb. 4, 2016—Co-pending U.S. Appl. No. 15/015,323.
Feb. 3, 2016—Co-pending U.S. Appl. No. 15/014,137.
Feb. 5, 2016—Co-pending U.S. Appl. No. 15/016,638.
May 19, 2016—Non-Final Office Action—U.S. Appl. No. 15/014,137.
Jun. 3, 2016—(US) Ex-parte Quayle Action—U.S. Appl. No. 15/016,638.
Jun. 17, 2016—(US) Non-Final Office Action—U.S. Appl. No. 15/016,616.
Oct. 11, 2016—(US) Notice of Allowance—U.S. Appl. No. 15/016,616.
Oct. 13, 2016—(US) Notice of Allowance—U.S. Appl. No. 15/016,638.
Nov. 4, 2016—(US) Non-Final Office Action—U.S. Appl. No. 15/015,788.

* cited by examiner

UP
REAR
RIGHT
DOWN
LEFT
FRONT

L1
L2
L3
L4
L5
15
15A
69
70
71
72L
72R
74
76A(76)
76B(76)
77
68L
68R
39
44
46A (46)
48L
48R
51
52
53
53A
54
56A
56B
57L2 (57L)
57R2 (57R)
18
19
20B (20L)
20B (20R)
21
81
81A
82
82A
82B
82C
83
A
C
D1
D2
14

LEFT
RIGHT
FRONT
REAR

IMAGE FORMING APPARATUS HAVING EXPOSURE UNIT AND PROCESS CARTRIDGE

CROSS REFERENCE TO RELATED APPLICATION

This application claims priority from Japanese Patent Application No. 2015-022596 filed Feb. 6, 2015. The entire content of the priority application is incorporated herein by reference.

TECHNICAL FIELD

The present disclosure relates to an electro-photographic type image forming apparatus.

BACKGROUND

A conventional electro-photographic type image forming apparatus includes: a plurality of photosensitive drums; exposure units each configured to expose each surface of each photosensitive drum to light to form an electrostatic latent image on each surface; developing units each configured to form a toner image on the surface of each photosensitive drum; and a belt unit on which toner images on the photosensitive drums are transferred.

United States Patent Application Publication No. 2013/328325 discloses such image forming apparatus including: a plurality of process units each being provided with a photosensitive drum; a belt unit positioned above the process units; LED units each facing a corresponding photosensitive drum from below; and a pair of first frames each formed with a plurality of drum positioning grooves and disposed interposing the belt unit in a leftward/rightward direction.

Each photosensitive drum has a pair of flange members each configured to be abutted on the drum positioning groove of the corresponding first frame from below by moving the photosensitive drum upward. By this abutment, positioning of the photosensitive drum relative to the belt unit is achieved.

SUMMARY

Recently, improvement on image forming accuracy is demanded. To this effect, an electrostatic latent image needs to be formed on the surface of the photosensitive drum at a high accuracy.

However, according to the conventional image forming apparatus described in the United States Patent Application Publication No. 2013/328325, the first frame formed with the drum positioning groove is positioned above the photosensitive drum, that is, is positioned opposite to the LED unit relative to the photosensitive drum. Therefore, positional accuracy between the photosensitive drum and the LED unit may not be improved even if the flange member of the photosensitive drum is brought into abutment with the drum positioning groove. Accordingly, in the conventional image forming apparatus, highly accurate formation of electrostatic latent image on the surface of the photosensitive drum may not be performed, and imaging accuracy is not improved.

It is therefore an object of an embodiment of the disclosure to provide an image forming apparatus capable of improving positional accuracy between a photosensitive drum and an exposure unit, thereby improving accuracy of imaging.

This and other objects will be attained by providing an image forming apparatus includes: a main casing; a process cartridge; a drawer; an exposure unit; a positioning member; and a pressing member. The process cartridge includes a photosensitive drum. The belt unit includes a belt and configured to move between a contact position, at which the belt contacts the photosensitive drum, and a separated position, at which the belt is separate from the photosensitive drum. The drawer is configured to support the process cartridge and move in a sliding direction between an internal position inside of the main casing and an external position outside of the main casing. The sliding direction is perpendicular to an axial direction of the photosensitive drum. The exposure unit is configured to expose the photosensitive drum to light. The exposure unit is disposed such that when the drawer supporting the process cartridge is in the internal position, the belt unit, the process cartridge, and the exposure unit are arranged in this order in a first direction such that the belt unit is positioned at an upstream side of the process cartridge in the first direction and the exposure unit is positioned at a downstream side of the process cartridge in the first direction. The positioning member is configured such that the photosensitive drum is engaged to the positioning member from an upstream side of the positioning member in the first direction so as to be positioned by the positioning member. The pressing member is configured to press the process cartridge from the upstream side toward the downstream side of the process cartridge in the first direction so as to position the photosensitive drum relative to the positioning member. The pressing member is configured to move between a first position, at which the pressing member presses the process cartridge, and a second position, at which pressing of the pressing member to the process cartridge is released.

BRIEF DESCRIPTION OF THE DRAWINGS

The particular features and advantages of the disclosure as well as other objects will become apparent from the following description taken in connection with the accompanying drawings, in which.

DETAILED DESCRIPTION

Figure 1:
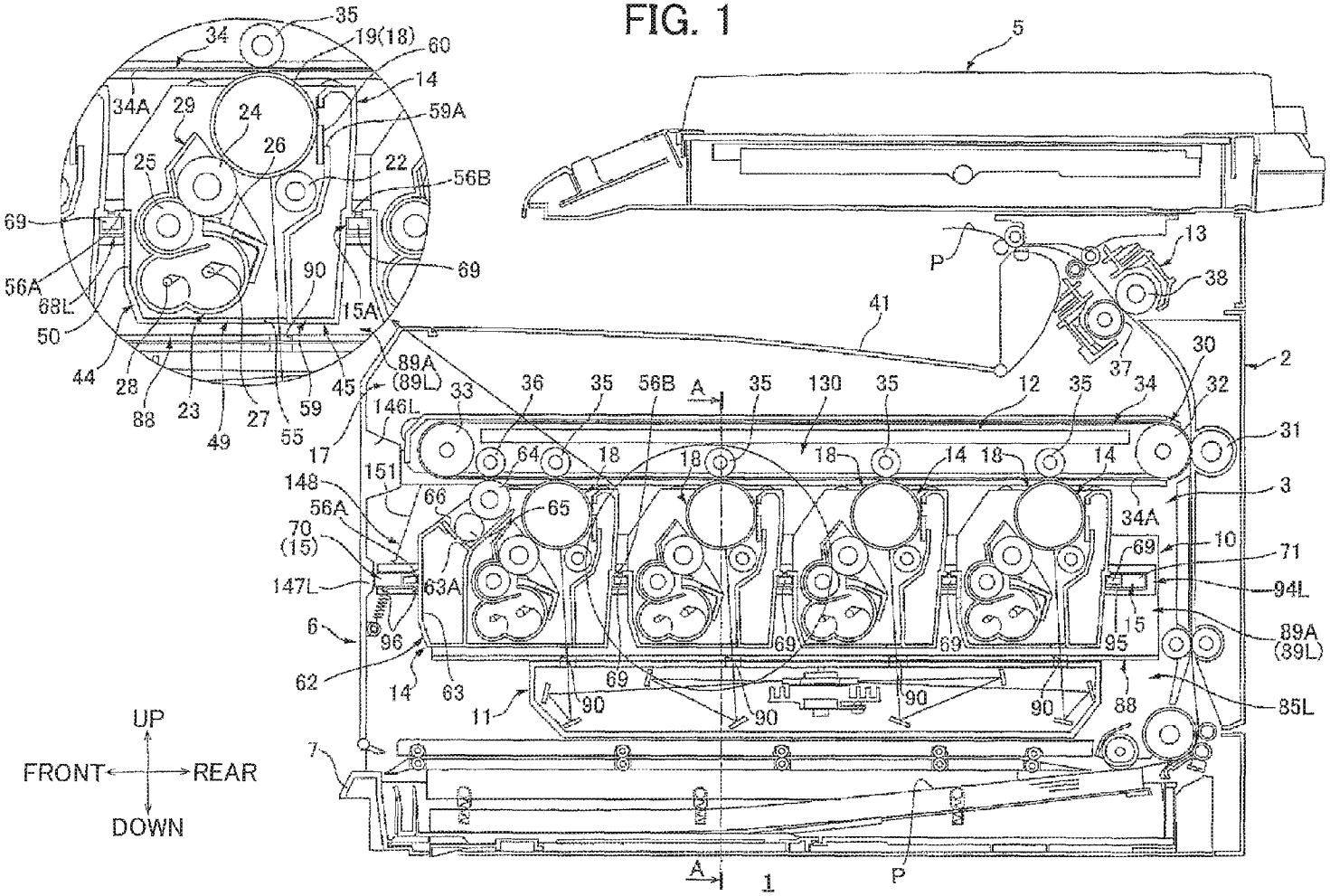
FIG. 1 is a cross-sectional side view of an image forming apparatus, according to a first embodiment, taken along a leftward/rightward center of the image forming apparatus, and showing a state where a front cover is at its closed position, and a drawer is at its internal position.

An image forming apparatus 1 according to a first embodiment will be described while referring to the accompanying drawings wherein like parts and components are designated by the same reference numerals to avoid duplicating description.

The terms "upward", "downward", "upper", "lower", "above", "below", "beneath", "right", "left", "front", "rear" and the like will be used throughout the description assuming that the image forming apparatus 1 is disposed in an orientation in which it is intended to be used. In use, the image forming apparatus 1 is disposed as shown in FIG. 1.

1. Entire Configuration of Image Forming Apparatus

As illustrated in FIG. 1, an image forming apparatus 1 is a horizontal intermediate transfer type color printer.

The image forming apparatus 1 includes a main casing 2, an image forming section 3 that forms an image on a sheet P, and an image read section 5 that reads image information on a document.

The main casing 2 has a substantially box shape. The main casing 2 includes a front cover 6 for closing an opening 17, a sheet supply tray 7, and a sheet discharge tray 41.

The opening 17 is formed at a front end portion of the main casing 2 and communicates an inside and an outside of the main casing 2 in a forward/rearward direction. The front cover 6 is configured to pivotally move about a lower end portion thereof between: a closed position (see FIG. 1) closing the opening 17; and an open position (see FIG. 7) opening the opening 17.

The sheet supply tray 7 is disposed at a lower end portion inside the main casing 2 and is configured to accommodate sheets P therein. Each sheet P accommodated in the sheet supply tray 7 is conveyed by various rollers at a predetermined timing to a position between an intermediate transfer belt 34 (to be described later) and a secondary transfer roller 31 (to be described later). The sheet discharge tray 41 is defined on an upper surface of the main casing 2.

The image forming section 3 includes an exposure unit 11, a transfer unit 12, a fixing unit 13, process cartridges 14, and a drawer 15.

The exposure unit 11 is disposed above the sheet supply tray 7 at a lower portion inside the main casing 2.

The drawer 15 is disposed in a substantial center inside the main casing 2 in the vertical direction (upward/downward direction) so as to be positioned above the exposure unit 11. The drawer 15 is configured to support four process cartridges 14. The drawer 15 is configured to move, while supporting the four process cartridges 14, in a forward/rearward direction between an internal position (see FIG. 1) inside the main casing 2 and an external position (see FIG. 12) outside the main casing 2 through the opening 17. That is, the opening 17 allows the four process cartridges 14 to pass therethrough.

Hereinafter, for descriptive convenience, it is assumed that the front cover 6 is situated at the closed position, and the drawer 15 is situated at the internal position.

The four process cartridges 14 are arrayed in the forward/rearward direction with gaps therebetween. The four process cartridges 14 each includes a photosensitive drum 18, a charge roller 22 for charging a surface of the photosensitive drum 18, and a developing unit 29 for supplying toner to the surface of the photosensitive drum 18.

The transfer unit 12 is disposed at an upper portion inside the main casing 2 so as to be positioned above the drawer 15 that supports the process cartridges 14. The transfer unit 12 includes a belt unit 30 and a secondary transfer roller 31. The belt unit 30 is disposed along the forward/rearward direction so as to be positioned above all the photosensitive drums 18. That is, the four process cartridges 14 are disposed between the belt unit 30 and the exposure unit 11.

The belt unit 30 includes a drive roller 32, a follower roller 33, an intermediate transfer belt 34, four primary transfer rollers 35, and an opposing roller 36.

The drive roller 32 is rotatably supported at a rear end portion of the belt unit 30. The follower roller 33 is rotatably supported at a front end portion of the belt unit 30.

The intermediate transfer belt 34 has a transfer surface 34A onto which a toner image is transferred and from which the toner image is transferred. The intermediate transfer belt 34 is stretched between the drive roller 32 and the follower roller 33 in such a manner that the transfer surface 34A at a lower portion of the intermediate transfer belt 34 contacts upper end portions of all the photosensitive drums 18. That is, the belt unit 30 is disposed facing the four photosensitive drums 18 in the vertical direction. By drive rotation of the drive roller 32 and following rotation of the follower roller 33, the intermediate transfer belt 34 circulates such that the lower portion thereof is moved from the front to the rear.

The four primary transfer rollers 35 are disposed between the drive roller 32 and the follower roller 33 so as to be arrayed in the forward/rearward direction with gaps therebetween. The primary transfer rollers 35 are each disposed above the corresponding photosensitive drum 18 with the intermediate transfer belt 34 sandwiched between the primary transfer roller 35 and the photosensitive drum 18.

The opposing roller 36 is disposed between the frontmost primary transfer roller 35 and the follower roller 33. The secondary transfer roller 31 is disposed rearward of the drive roller 32 with the intermediate transfer belt 34 sandwiched between the secondary transfer roller 31 and the drive roller 32.

The fixing unit 13 is disposed above the secondary transfer roller 31. The fixing unit 13 includes a heating roller 37 and a pressurizing roller 38 that is brought into pressure contact with an upper rear end portion of the heating roller 37.

The image read section 5 is disposed above the main casing 2 so as to cover the sheet discharge tray 41 from above.

With the above-described configuration, the image forming apparatus 1 starts image forming operation under control of a control section (not illustrated). When the image forming operation is started, the charge roller 22 uniformly charges the surface of the photosensitive drum 18. Thereafter, as indicated by solid lines, the exposure unit 11 emits laser beams based on image data toward the surfaces of the plurality of photosensitive drums 18 through laser passing ports 55 (to be described later) and laser passing holes 90 (to be described later) to expose the photosensitive drums 18. As a result, an electrostatic latent image based on the image data is formed on each of the photosensitive drums 18.

The image data may include, for example, image data transmitted to the image forming apparatus 1 from a personal computer (not illustrated) connected to the image forming apparatus 1, image data read by the image read section 5, and the like.

Each developing unit 29 supplies toner to the electrostatic latent image on a corresponding photosensitive drum 18. As a result, each photosensitive drum 18 carries a toner image on the surface thereof.

The toner image carried on the surface of each photosensitive drum 18 is subjected to a primary-transfer process, by the primary transfer roller 35, onto the transfer surface 34A at the lower portion of the intermediate transfer belt 34 that is moved from the front to rear. As a result, a multi-color image is formed on the transfer surface 34A at the lower portion of the intermediate transfer belt 34.

The secondary transfer roller 31 performs a secondary-transfer process to transfer the multi-color image formed on the surface of the intermediate transfer belt 34 onto a sheet P supplied from the sheet supply tray 7. Thereafter, while the sheet P on which the multi-color image has been formed passes through between the heating roller 37 and the pressurizing roller 38, the fixing unit 13 thermally fixes the multi-color image onto the sheet P. Subsequently, the sheet P on which the multi-color image has been fixed is discharged to the sheet discharge tray 41 by means of various rollers.

2. Details of Drawer

Figures 2A, 2B, 2C:
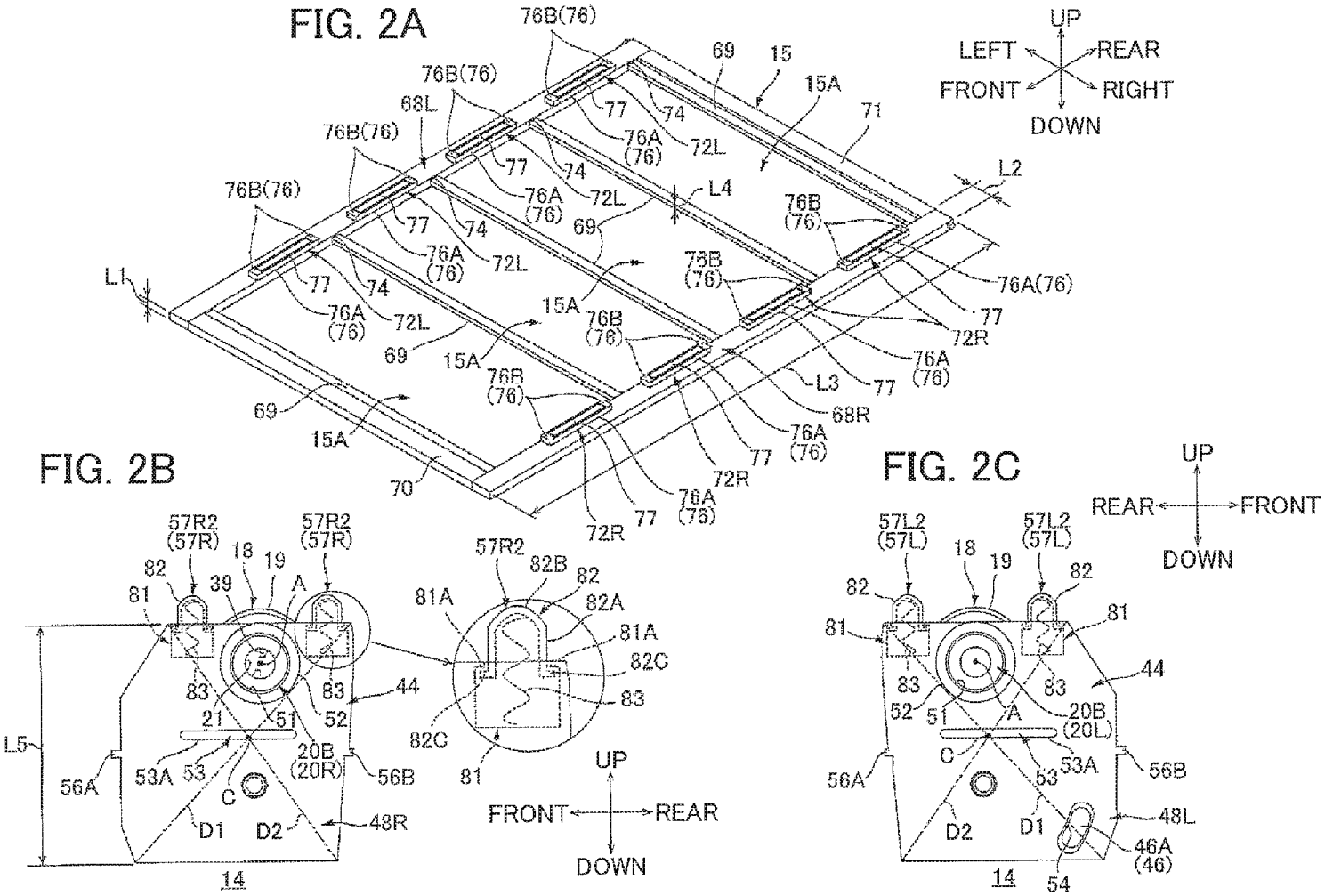
FIG. 2A is a perspective view of the drawer as viewed from frontward and upward of the drawer.
FIG. 2B is a right side view of a process cartridge in the image forming apparatus shown in FIG. 1.
FIG. 2C is a left side view of the process cartridge shown in FIG. 2B.

As illustrated in FIG. 2A, the drawer 15 has a substantially rectangular frame shape in a plan view and includes a first side frame 68R, a second side frame 68L, five beam members 69, a front beam 70, a rear beam 71, and four first biasing parts 72R, and four second biasing parts 72L.

(1) Side Frame

The first side frame 68R is disposed at a right end portion of the drawer 15. The second side frame 68L is disposed at a left end portion of the drawer 15. The first side frame 68R and the second side frame 68L are disposed at the same vertical position.

The first side frame 68R is formed of a hard resin material and has a substantially bar shape, more specifically, a substantially rectangular columnar shape, extending in the forward/rearward direction. The first side frame 68R has, in a left surface thereof, five fitting holes 74 disposed spaced apart from one another in the forward/rearward direction. The first side frame 68R has a vertical dimension L1 in the vertical direction, a leftward/rightward dimension L2 in the leftward/rightward direction, and a forward/rearward dimension L3 in the forward/rearward direction. The vertical dimension L1 and leftward/rightward dimension L2 are shorter than the forward/rearward dimension L3. The vertical dimension L1 is shorter than the leftward/rightward dimension L2. The five fitting holes 74 of the first side frame 68R each have a substantially rectangular shape in a side view and are each recessed to the right from the left surface of the first side frame 68R.

The second side frame 68L has the same configuration as that of the first side frame 68R except that the left and right sides thereof are reversed.

(2) Beam Member

The five beam members 69 are disposed between the first side frame 68R and the left side frame 68L at an equal interval from one another in the forward/rearward direction. The beam member 69 is formed of a metal material having a relatively high rigidity, such as a stainless steel and has a substantially bar shape, more specifically, a substantially rectangular columnar shape, extending in the leftward/rightward direction.

A right end portion of the beam member 69 is fitted into the fitting hole 74 of the first side frame 68R. A left end portion of the beam member 69 is fitted into the fitting hole 74 of the second side frame 68L. As a result, the beam member 69 connects the first side frame 68R and the second side frame 68L in the leftward/rightward direction. A space between the first side frame 68R and the left side frame 68L is divided into four sections in the forward/rearward direction by the five beam members 69. In other words, four insertion openings 15A are defined between the first side frame 68R and the second side frame 68L.

(3) Front Beam and Rear Beam

The front beam 70 is disposed between a front end portion of the first side frame 68R and a front end portion of the second side frame 68L at a position forward of the frontmost beam member 69. The front beam 70 is formed of a hard resin material and has a substantially rectangular columnar shape extending in the leftward/rightward direction. A right end portion of the front beam 70 is continuous to the front end portion of the first side frame 68R. A left end portion of the front beam 70 is continuous to the front end portion of the second side frame 68L.

The rear beam 71 is disposed between a rear end portion of the first side frame 68R and a rear end portion of the second side frame 68L at a position rearward of the rearmost beam member 69. The rear beam 71 is formed of a hard resin material and has a substantially rectangular columnar shape extending in the leftward/rightward direction. A right end portion of the rear beam 71 is continuous to the rear end portion of the first side frame 68R. A left end portion of the rear beam 71 is continuous to the rear end portion of the second side frame 68L.

(4) Biasing Part

The four first biasing parts 72R are disposed on an upper surface of the first side frame 68R, spaced apart from one another in the forward/rearward direction. The four second biasing parts 72L are disposed on an upper surface of the second side frame 68L, spaced apart from one another in the forward/rearward direction. Each of the four first biasing parts 72R and each of the four second biasing parts 72L are disposed spaced apart from each other in the leftward/rightward direction with each of the four insertion openings 15A interposed therebetween.

Figure 5:
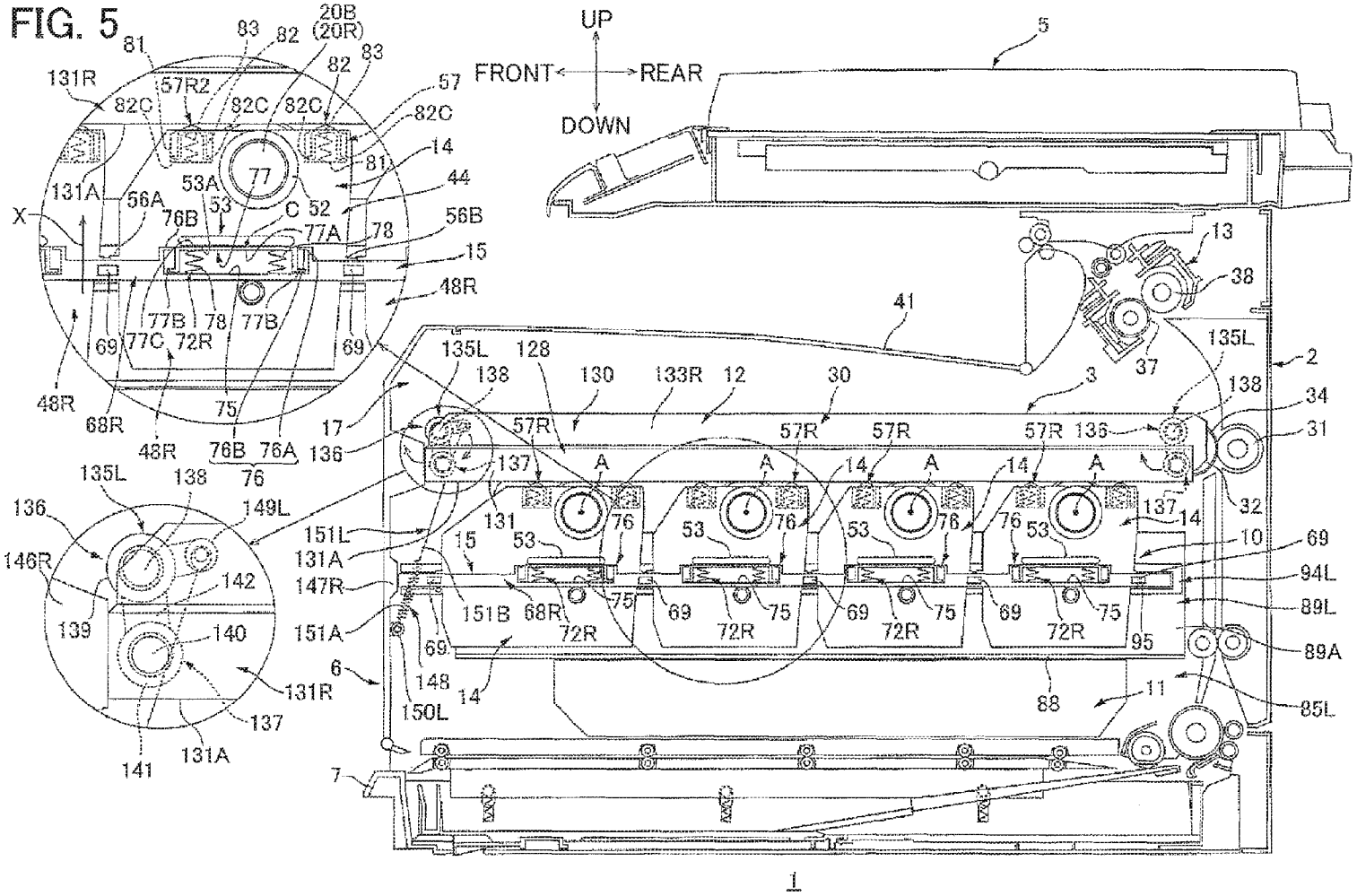
FIG. 5 is a cross-sectional side view of the image forming apparatus taken along a line B-B of FIG. 4.

As illustrated in FIG. 2A and FIG. 5, each first biasing part 72R includes: an accommodation concave part 75; a guide part 76 (an example of a first guide part); an advance/retract part 77 (an example of a first advance/retract part); and two biasing members 78.

As illustrated in FIG. 5, the accommodation concave part 75 has a substantially rectangular shape in a side view extending in the forward/rearward direction and is recessed downward from the upper surface of the first side frame 68R.

As illustrated in FIG. 2A, the guide part 76 is disposed on the upper surface of the first side frame 68R so as to surround the accommodation concave part 75 in a plan view. The guide part 76 integrally includes a frame part 76A and two restricting projections 76B. On the upper surface of the first side frame 68R, the frame part 76A protrudes upward from the entire periphery of the accommodation concave part 75.

The two restricting projections 76B are disposed at an upper end portion of the guide part 76, spaced apart from each other in the forward/rearward direction. As illustrated in FIG. 5, the front one of the two restricting projections 76B protrudes rearward from an upper end portion of a front wall constituting the frame part 76A. The rear one of the two restricting projections 76B protrudes forward from an upper end portion of a rear wall constituting the frame part 76A. As illustrated in FIG. 2A, a left end portion of each restricting projection 76B is connected to an upper end portion of a left side wall constituting the frame part 76A. A right end portion of each restricting projection 76B is connected to an upper end portion of a right side wall constituting the frame part 76A.

As illustrated in FIG. 5, the advance/retract part 77 is accommodated in a space defined by the accommodation concave part 75 and the guide part 76. The advance/retract part 77 integrally includes a contact portion 77A and two restricting portions 77B.

As illustrated in FIG. 2A, the contact portion 77A is disposed between the two restricting projections 76B in the forward/rearward direction. The contact portion 77A has a substantially rectangular shape extending in the forward/rearward direction in a plan view and, as illustrated in FIG. 5, a substantially concave shape opened downward in a side view. An upper surface 77C (an example of a third contact surface) of the contact portion 77A (an example of a first contact portion) faces upward and extends both in the leftward/rightward and frontward/rearward directions.

The front one (an example of a first restricting portion) of the two restricting portions 77B is disposed at a front end portion of the advance/retract part 77 and at a front end portion of the first biasing part 72R. The rear one (an example of a second restricting portion) of the two restricting portions 77B is disposed at a rear end portion of the advance/retract part 77 and at a rear end portion of the first biasing part 72R. The front restricting portion 77B protrudes forward from a lower end portion of a front wall constituting the contact portion 77A. The rear restricting portion 77B protrudes rearward from a lower end portion of a rear wall constituting the contact portion 77A. The two restricting portions 77B are disposed below the two restricting projections 76B, respectively.

The front one (an example of a first biasing member) of the two biasing members 78 is a compression spring disposed in a compressed state at a front end portion in the contact portion 77A. The rear one (an example of a second biasing member) of the two biasing members 78 is a compression spring disposed in a compressed state at a rear end portion in the contact portion 77A. The front and rear biasing members 78 are disposed in the forward/rearward direction with a center C of the process cartridge 14 interposed therebetween in a side view. The compression spring is a coil spring extending in the vertical direction. An upper end portion of the biasing member 78 contacts a lower surface of an upper wall constituting the contact portion 77A, and a lower end portion thereof contacts a bottom surface of the accommodation concave part 75. As a result, the two biasing members 78 bias the advance/retract part 77 upward.

Figure 4:
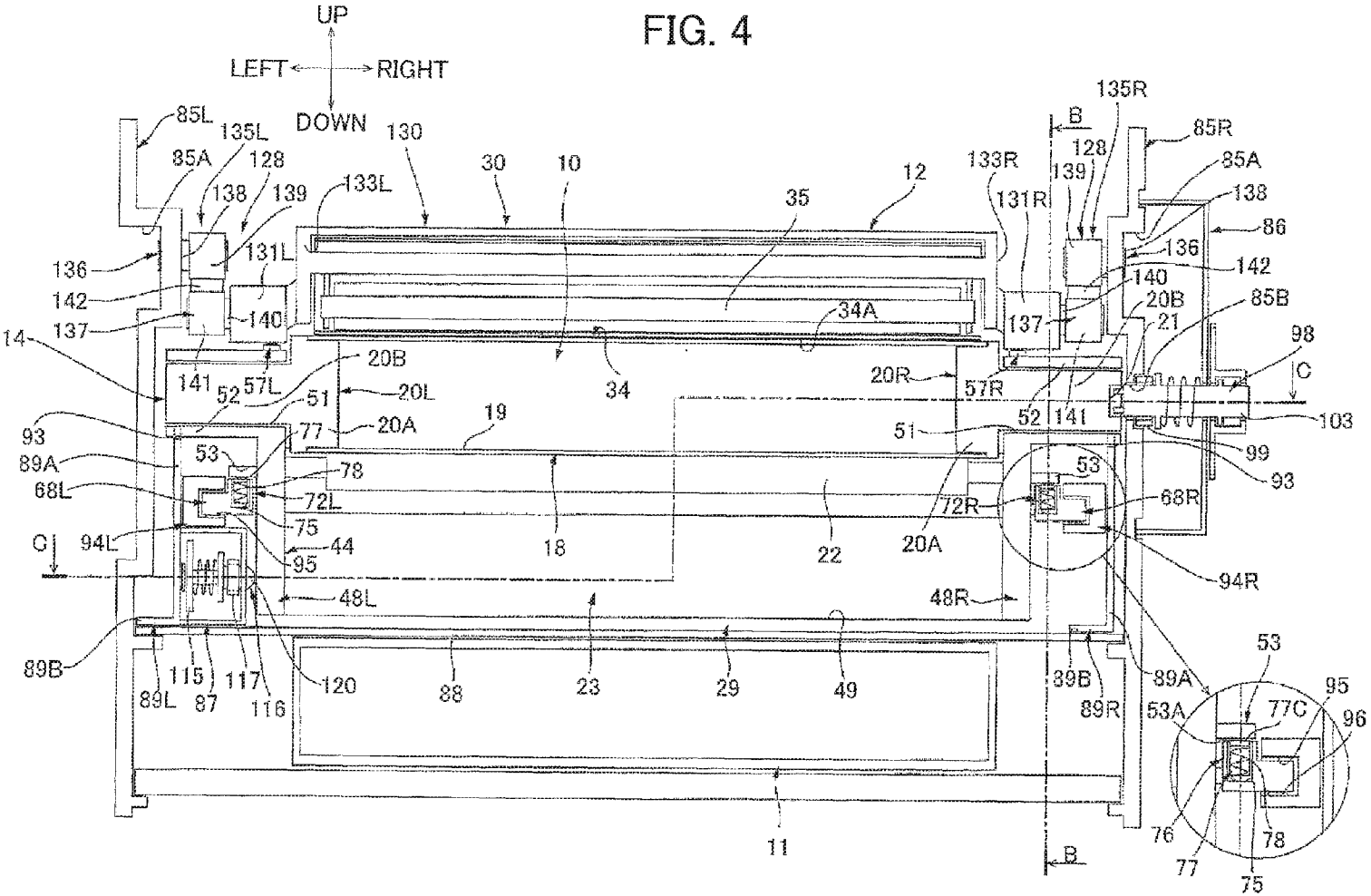
FIG. 4 is a cross-sectional view of the image forming apparatus taken along a line A-A in FIG. 1.

As illustrated in FIGS. 4 and 5, the second biasing part 72L has the same configuration as that of the first biasing part 72R except that the left and right sides thereof are reversed. The second biasing part 72L includes an accommodation concave part 75, a guide part 76 (an example of a second guide part), an advance/retract part 77 (an example of a second advance/retract part), a front biasing member 78 (an example of a third biasing member), and a rear biasing member 78 (an example of a fourth biasing member). The advance/retract part 77 includes: a contact portion 77A (an example of a second contact portion) having an upper surface 77C (an example of a fourth contact surface); a front restricting portion 77B (an example of a third restricting portion); and a rear restricting portion 77B (an example of a fourth restricting portion).

3. Details of Process Cartridge

As illustrated in FIG. 1 and FIG. 2B, the process cartridge 14 includes a cartridge frame 44, a photosensitive drum 18, a charge roller 22, a developing unit 29, a cartridge electrode 46, a drum cleaning unit 45, a first engagement rib 56A, a second engagement rib 56B, a first pressing unit 57R, and a second pressing unit 57L. The frontmost one of the four process cartridges 14 further includes a belt cleaning unit 62.

(1) Cartridge Frame

The cartridge frame 44 has a substantially rectangular cylindrical shape extending in the leftward/rightward direction. The cartridge frame 44 has a vertical dimension L5 in the vertical direction. The vertical dimension L5 of the cartridge frame 44 is longer than the vertical dimension L1 of the first side frame 68R. As illustrated in FIG. 1, FIG. 2B, and FIG. 2C, the cartridge frame 44 includes a first side wall 48R, a second side wall 48L, and a bottom wall 49.

The first side wall 48R is disposed at a right end portion of the cartridge frame 44. The second side wall 48L is disposed at a left end portion of the cartridge frame 44.

As illustrated in FIG. 2B, the first side wall 48R has a substantially rectangular plate shape in a side view. The first side wall 48R includes a flange insertion port 51, an engagement part 52, and a protruding part 53 (an example of a first protruding part).

The flange insertion port 51 is disposed in a substantial center, in the forward/rearward direction, of an upper portion of the first side wall 48R. The flange insertion port 51 has a substantially circular shape in a side view and penetrates the first side wall 48R in the leftward/rightward direction.

As illustrated in FIG. 4, the engagement part 52 is disposed on a right surface of the first side wall 48R and has a substantially cylindrical shape protruding rightward from the entire periphery of the flange insertion port 51 of the first side wall 48R.

As illustrated in FIG. 2B, the protruding part 53 is disposed in a substantial center, in the vertical direction, of a right surface of the first side wall 48R. The protruding part 53 is disposed below the engagement part 52 and spaced apart from the engagement part 52. The protruding part 53 is disposed overlapping with the center C of the process cartridge 14 as viewed in the leftward/rightward direction.

The center C of the process cartridge 14 is an intersection between a diagonal line D1 connecting an upper rear corner point and a lower front corner point of the first side wall 48R and a diagonal line D2 connecting a lower rear corner point and an upper front corner point of the first side wall 48R.

The protruding part 53 has a substantially plate shape extending in the forward/rearward direction and overlapping with a center axis of the engagement part 52 as viewed in the vertical direction. As illustrated in FIG. 4, the protruding part 53 protrudes rightward from the right surface of the first side wall 48R. A protruding amount of the protruding part 53 (the dimension of the protruding part 53 in the leftward/rightward direction) is shorter than a protruding amount of the engagement part 52 (the dimension of the engagement part 52 in the leftward/rightward direction). A lower surface 53A (an example of a first contact surface) of the protruding part 53 faces downward and extends in both the leftward/rightward direction and the forward/rearward direction.

As illustrated in FIG. 2C, the second side wall 48L has a substantially rectangular plate shape in a side view. The second side wall 48L includes a flange insertion port 51, an engagement part 52, a protruding part 53 (an example of a second protruding part) including a lower surface 53A (an example of a second contact surface), and an electrode opening part 54. The flange insertion port 51, the engagement part 52, and the protruding part 53 of the second side wall 48L have the same configurations as those of the first side wall 48R, respectively, except that the left and right sides thereof are reversed.

The electrode opening part 54 is disposed at a front end portion of a lower portion of the second side wall 48L. The electrode opening part 54 has a substantially ellipsoidal shape in a side view extending in a direction connecting the upper front side to lower rear side and penetrates the second side wall 48L in the leftward/rightward direction.

As illustrated in FIG. 1, the bottom wall 49 is provided between a lower end portion of the first side wall 48R and a lower end portion of the second side wall 48L and has a substantially rectangular plate shape in a bottom view. The bottom wall 49 has a laser passing port 55 at a rear portion thereof. The laser passing port 55 penetrates the bottom wall 49 in the vertical direction.

In each of the process cartridges 14 excluding the frontmost process cartridge 14, the cartridge frame 44 further includes a front wall 50.

The front wall 50 is provided between a lower portion of a front end portion of the first side wall 48R and a lower portion of a front end portion of the second side wall 48L and has a substantially rectangular plate shape in a front view. A lower end portion of the front wall 50 is connected to a front end portion of the bottom wall 49.

(2) Photosensitive Drum

As illustrated in FIGS. 1 and 4, the photosensitive drum 18 is disposed in a substantial center, in the forward/rearward direction, in an upper end portion of the process cartridge 14. As illustrated in FIG. 4, the photosensitive drum 18 includes a drum body 19, a first flange 20R, and a second flange 20L.

The drum body 19 has a substantially cylindrical shape extending in the leftward/rightward direction. The drum body 19 has a photosensitive layer disposed on the surface thereof.

The first flange 20R is disposed at a right end portion of the photosensitive drum 18. The first flange 20R integrally includes a first part 20A and a second part 20B. The first part 20A constitutes a left-side part of the first flange 20R and has a substantially columnar shape extending in the leftward/rightward direction. An outer diameter of the first part 20A is substantially equal to an inner diameter of the drum body 19.

The second part 20B constitutes a right-side part of the first flange 20R. The second part 20B has a substantially columnar shape sharing a center axis with the first part 20A and extends rightward from a right end face of the first part 20A. An outer diameter of the second part 20B is smaller than the outer diameter of the first part 20A and substantially equal to an inner diameter of the flange insertion port 51.

As illustrated in FIG. 2B, the first flange 20R includes a coupling concave part 21 and a pair of projections 39.

The coupling concave part 21 is disposed at a right end face of the second part 20B of the first flange 20R. The coupling concave part 21 has a substantially circular shape in a side view and is recessed leftward from the right end face of the second part 20B.

The pair of projections 39 are disposed in the coupling concave part 21, spaced apart from each other in a radial direction of the coupling concave part 21. The projections 39 each have a rectangular shape in a side view and each project inward in the radial direction from an inner peripheral surface of the coupling concave part 21.

As illustrated in FIG. 4, the first flange 20R is supported by the drum body 19 with the first part 20A inserted into a right end portion of the drum body 19 so as not to be rotatable relative to the drum body 19.

As illustrated in FIG. 2B, the thus configured photosensitive drum 18 is supported by the first side wall 48R so as to be rotatable relative to the first side wall 48R about a center axis A of the photosensitive drum 18, with the second part 20B of the first flange 20R inserted into the flange insertion port 51 and supported by the engagement part 52. When being projected in the vertical direction, the center axis A of the photosensitive drum 18 overlaps with a rear portion of the protruding part 53.

As illustrated in FIG. 4, the second flange 20L is disposed at a left end portion of the photosensitive drum 18. The second flange 20L has the same configuration as that of the first flange 20R except that the left and right sides thereof are reversed and that the second flange 20L does not include the coupling concave part 21 or pair of the projections 39.

(3) Charge Roller and Developing Unit

As illustrated in FIG. 1, the charge roller 22 is disposed at the lower rear of the photosensitive drum 18. An upper front end portion of the charge roller 22 contacts a lower rear end portion of the photosensitive drum 18.

The developing unit 29 is disposed at the lower front of the photosensitive drum 18. The developing unit 29 includes a developing frame 23, a developing roller 24, a supply roller 25, a layer thickness regulating blade 26, a first agitator 27, and a second agitator 28.

The developing frame 23 has a substantially hollow shape whose left and right end portions are closed and configured to accommodate toner therein. The developing roller 24 carries the toner on a surface thereof and supplies the toner to the surface of the photosensitive drum 18. The supply roller 25 supplies the toner in the developing frame 23 to the developing roller 24. The layer thickness regulating blade 26 regulates a thickness of the toner carried on the developing roller 24. The first agitator 27 agitates the toner in the developing frame 23 and supplies the toner to the supply roller 25. The second agitator 28 agitates the toner in the developing frame 23 and supplies the toner to the first agitator 27.

(4) Cartridge Electrode

Figure 6:
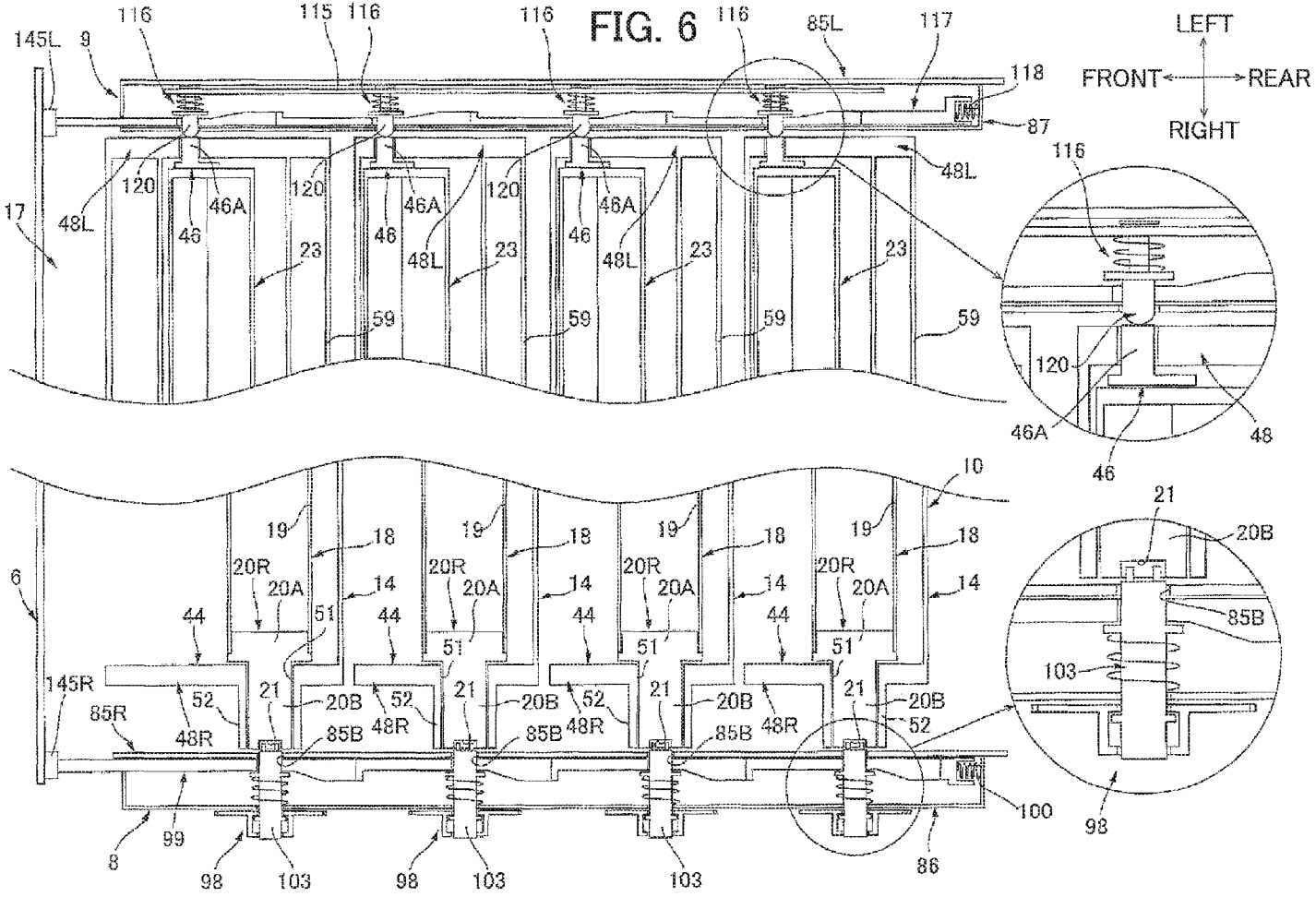
FIG. 6 is a cross-sectional view of the image forming apparatus taken along a line C-C of FIG. 4.

As illustrated in FIGS. 2C and 6, the cartridge electrode 46 supplies electric power from a power supply unit 9 (to be described later) to the developing roller 24 and the supply roller 25. As illustrated in FIG. 6, the cartridge electrode 46 is disposed on a left surface of a left side wall constituting the developing frame 23 and has an electrical contact part 46A.

As illustrated in FIG. 2C, the electrical contact part 46A has a substantially ellipsoidal shape in a side view extending in a direction connecting the upper front side to lower rear side. The electrical contact part 46A is inserted through the electrode opening part 54 to be exposed from the second side wall 48L. A left end face of the electrical contact part 46A and a left surface of the second side wall 48L are substantially flush with each other.

(5) Drum Cleaning Unit

As illustrated in FIG. 1, the drum cleaning unit 45 is configured to collect waste toner from the surface of the photosensitive drum 18. The drum cleaning unit 45 is disposed rearward of the photosensitive drum 18 at a rear end portion of the process cartridge 14. The drum cleaning unit 45 includes a frame 59 and a cleaning blade 60.

The frame 59 is disposed between the rear end portion of the first side frame 48R and the rear end portion of the second side frame 48L and has a substantially rectangular cylindrical shape extending in the leftward/rightward direction. A right end portion of the frame 59 is closed by the first side wall 48R, and a left end portion of the frame 59 is closed by the second side wall 48L. The frame 59 has an opening 59A at a portion thereof facing the photosensitive drum 18.

The cleaning blade 60 has a substantially plate shape extending in the vertical direction. A lower end portion of the cleaning blade 60 is fixed to a lower periphery of the opening 59A of the frame 59, and an upper end portion of the cleaning blade 60 contacts a rear end portion of the drum body 19 of the photosensitive drum 18.

(6) Belt Cleaning Unit

The belt cleaning unit 62 is configured to collect waste toner from a surface of the intermediate transfer belt 34. The belt cleaning unit 62 is disposed at a front end portion of the frontmost process cartridge 14 and forward of the developing unit 29. The belt cleaning unit 62 includes a frame 63, a primary roller 64, a secondary roller 65, and a cleaning blade 66.

The frame 63 is disposed between the front end portion of the first side wall 48R and the front end portion of the second side wall 48L and has substantially a rectangular cylindrical shape extending in the leftward/rightward direction. A right end portion of the frame 63 is closed by the first side wall 48R, and a left end portion of the frame 63 is closed by the second side wall 48L. The frame 63 has an opening 63A at an upper rear portion thereof.

The primary roller 64 is disposed below the opposing roller 36 so as to sandwich the intermediate transfer belt 34 between the primary roller 64 and opposing roller 36. The secondary roller 65 is disposed at the lower front of the primary roller 64 and at the upper rear of the opening 63A. An upper rear end portion of the secondary roller 65 contacts a lower front end portion of the primary roller 64.

The cleaning blade 66 has a substantially plate shape extending in a direction connecting the upper front side to lower rear side. An upper front end portion of the cleaning blade 66 is fixed to an upper periphery of the opening 63A of the frame 63, and a lower rear end portion of the cleaning blade 66 contacts a lower front end portion of the secondary roller 65.

(7) Engagement Rib

As illustrated in FIG. 1, the first engagement rib 56A is disposed at a front end portion of the process cartridge 14. The second engagement rib 56B is disposed at a rear end portion of the process cartridge 14. The first engagement rib 56A and the second engagement rib 56B are disposed at the same vertical position.

More in detail, in the frontmost process cartridge 14, the first engagement rib 56A is continued from a substantial center, in the vertical direction, of a front surface of the frame 63 of the belt cleaning unit 62 and protrudes forward, and the second engagement rib 56B is continued from a substantial center, in the vertical direction, of a rear surface of the frame 59 of the drum cleaning unit 45 and protrudes rearward.

On the other hand, in each of the process cartridges 14 other than the frontmost process cartridge 14, the first engagement rib 56A is continued from an upper end portion of the front wall 50 and protrudes forward, and the second engagement rib 56B is continued from a substantial center, in the vertical direction, of the rear surface of the frame 59 of the drum cleaning unit 45 and protrudes rearward.

(8) Pressing Unit

As illustrated in FIG. 2B, the first pressing unit 57R is disposed at a right end portion of the process cartridge 14. Further, as illustrated in FIG. 2C, the second pressing unit 57L is disposed at a left end portion of the process cartridge 14.

As illustrated in FIG. 2B, the first pressing unit 57R includes two pressed parts 57R2. The two pressed parts 57R2 are disposed spaced apart from each other in the forward/rearward direction so as to sandwich the photosensitive drum 18 therebetween as viewed in the leftward/rightward direction. Each pressed part 57R2 includes: a support frame 81; an abutted part 82 (an example of a first abutted part); and a biasing member 83 (an example of a first cartridge biasing member).

The support frame 81 is disposed at an upper end portion of the left surface of the first side wall 48R. The support frame 81 has a substantially concave shape in a side view opened upward. The support frame 81 is continued from the left surface of the first side wall 48R and protrudes leftward. A left end portion of the support frame 81 is closed. The support frame 81 includes two engagement projections 81A.

The two engagement projections 81A are disposed at an upper end portion of the support frame 81, spaced apart from each other in the forward/rearward direction. The front one of the two engagement projections 81A is continued from an upper end portion of a front wall constituting the support frame 81 and protrudes rearward. The rear one of the two engagement projections 81A is continued from an upper end portion of a rear wall constituting the support frame 81 and protrudes forward.

The abutted part 82 is supported by the support frame 81 so as to be movable in the vertical direction. The abutted part 82 integrally includes a cylindrical part 82A, a circular arc part 82B, and two restricting projections 82C.

The cylindrical part 82A has a substantially rectangular cylindrical shape extending in the vertical direction. The circular arc part 82B closes an upper end portion of the cylindrical part 82A. The circular arc part 82B has a substantially semicircular arc shape in a side view protruding upward. The front one of the two restricting projections 82C is continued from a lower end portion of a front wall constituting the cylindrical part 82A and protrudes forward. The rear one of the two restricting projections 82C is continued from a lower end portion of a rear wall constituting the cylindrical part 82A and protrudes rearward.

The abutted part 82 is inserted into the support frame 81 such that the two restricting projections 82C are positioned below the two engagement projections 81A, respectively.

As a result, the abutted part 82 can be moved in the vertical direction between an advanced position (see FIG. 10) and a retracted position (see FIG. 5). That is, the abutted part 82 can move: upward, i.e., to the transfer unit 12 side until the restricting projections 82C contact the engagement projections 81A from below; and downward, i.e., to the exposure unit 11 side such that the cylindrical part 82A is accommodated inside the support frame 81. When the abutted part 82 is at the retracted position, the abutted part 82 is positioned nearer to the exposure unit 11 than when the abutted part 82 is at the advanced position.

The biasing member 83 is a coil spring extending in the vertical direction and has a resilient force. The biasing member 83 is disposed in a compressed state between a bottom wall constituting the support frame 81 and the circular arc part 82B of the abutted part 82. A lower end portion of the biasing member 83 contacts an upper surface of the bottom wall of the support frame 81, and an upper end portion of the biasing member 83 contacts a lower surface of the circular arc part 82B. The biasing member 83 is accommodated in the cylindrical part 82A so as to contact an inner peripheral surface of the cylindrical part 82A of the abutted part 82.

With this configuration, the abutted part 82 is always biased toward the advanced position by the biasing member 83. In a state where the front cover 6 is situated at the closed position, the abutted part 82 is abutted by a first pressing member 131R (to be described later) from above so as to be pressed downward against the biasing force of the biasing member 83 and situated at the retracted position.

As illustrated in FIG. 2C, the second pressing unit 57L includes two pressed parts 57L2. Each pressed part 57L2 includes: a support frame 81; an abutted part 82 (an example of a second abutted part); and a biasing member 83 (an example of a second cartridge biasing member). The second pressing unit 57L has the same configuration as that of the first pressing unit 57R except that the left and right sides thereof are reversed.

(9) Mounted State of Process Cartridge to Drawer

As illustrated in FIG. 5, the process cartridge 14 is inserted through the insertion opening 15A of the drawer 15 in the vertical direction such that the lower surface 53A of the protruding part 53 of the first side wall 48R contacts from above the upper surface 77C of the contact portion 77A of the first biasing part 72R and that the lower surface 53A of the protruding part 53 of the second side wall 48L contacts from above the upper surface 77C of the contact portion 77A of the second biasing part 72L.

Thus, the four process cartridges 14 are supported by the drawer 15 so as to be disposed between the first side frame 68R and the second side frame 68L in the leftward/rightward direction. A lower part of the process cartridge 14 is exposed from the drawer 15 at an area below the drawer 15, and an upper part of the process cartridge 14 is exposed from the drawer 15 at an area above the drawer 15.

Figure 10:
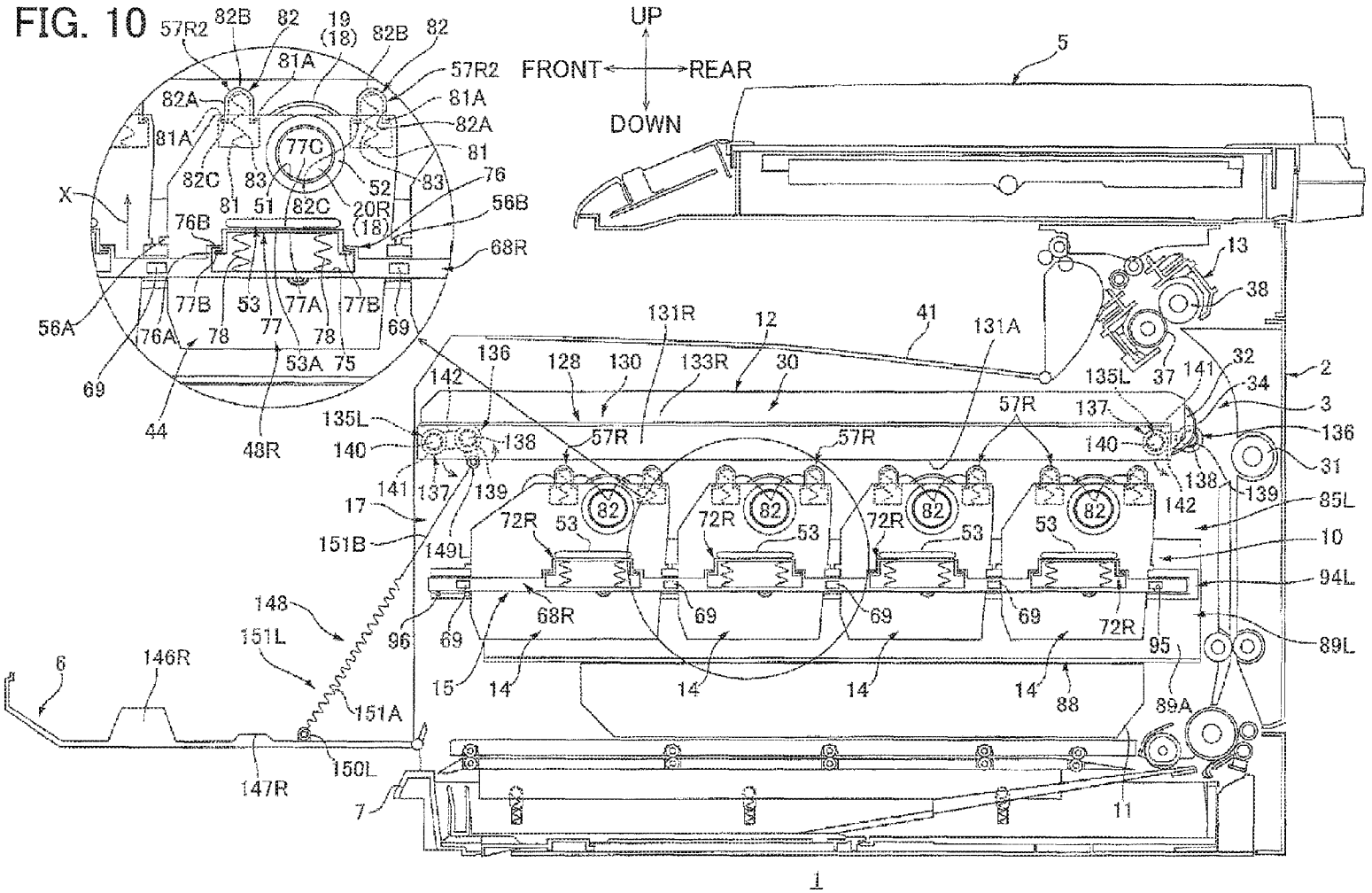
FIG. 10 is a cross-sectional side view of the image forming apparatus shown in FIG. 7 and taken along a line corresponding to the line B-B of FIG. 4.
Figure 12:
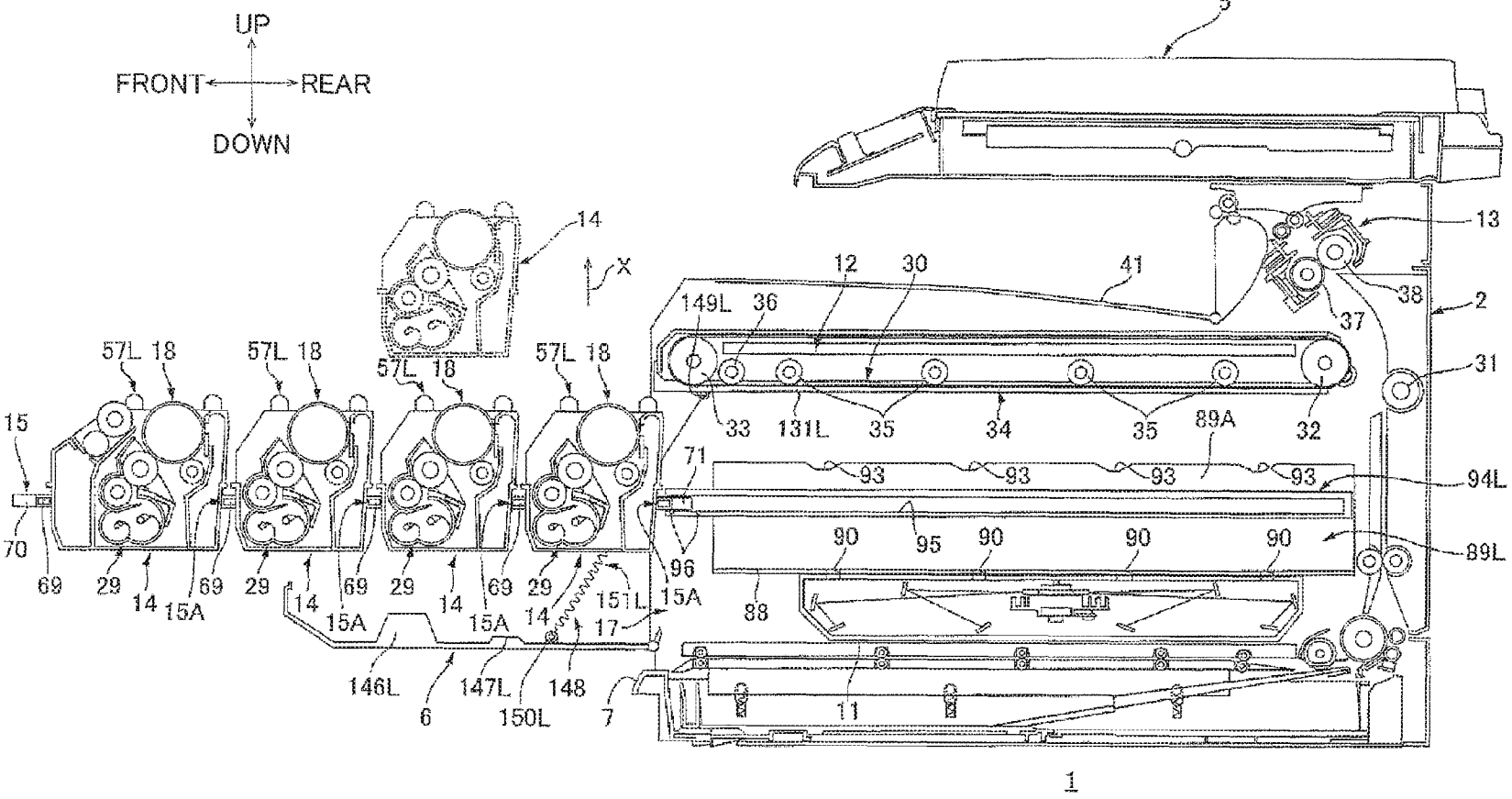
FIG. 12 is a cross-sectional side view of the image forming apparatus, according to the first embodiment, taken along the leftward/rightward center thereof, and showing a state where the front cover is at its open position, and the drawer is at its external position.

The process cartridge 14 is configured to be linearly movable in the vertical direction between an engagement position (see FIGS. 1 and 5) and an engagement released position (see FIGS. 7 and 10) located above the engagement position. The engagement position is a position at which, in a state where the process cartridge 14 is supported by the drawer 15, the first engagement rib 56A contacts from above the beam member 69 positioned forward of the process cartridge 14, and the second engagement rib 56B contacts from above the beam member 69 positioned rearward of the process cartridge 14. The engagement released position is a position at which the first engagement rib 56A is separated upward from the beam member 69 positioned forward of the process cartridge 14, and the second engagement rib 56B is separated upward from the beam member 69 positioned rearward of the process cartridge 14. In other words, while being supported by the drawer 15, the process cartridge 14 can be moved between an upstream position and a downstream position relative to each other in a separating direction X (upward direction), wherein the separating direction X is a direction in which the process cartridge 14 is separated from the drawer 15 as indicated in FIGS. 5, 10, and 12. The process cartridge 14 is positioned at the upstream position in a state of being situated at the engagement position (see FIG. 5) and at the downstream position in a state of being situated at the engagement released position (see FIG. 10).

The process cartridge 14 is always biased toward the engagement released position, i.e., the belt unit 30 by the first biasing part 72R and the second biasing part 72L.

In a state where the abutted parts 82 are situated at the retracted position, the process cartridge 14 is pressed downward by the biasing force of the two biasing members 83 in the first pressing unit 57R and the two biasing members 83 in the second pressing unit 57L, against the biasing force of the two biasing members 78 in the first biasing part 72R and the two biasing members 78 in the second biasing part 72L which are provided to the drawer 15.

4. Details of Main Casing

As illustrated in FIG. 4, the main casing 2 includes a first inner wall 85R, a second inner wall 85L, a connecting plate 88, a first positioning member 89R, a second positioning member 89L, a first guide rail 94R, and a second guide rail 94L.

(1) Inner Wall

The first inner wall 85R is disposed at a right end portion of the main casing 2. The second inner wall 85L is disposed at a left end portion of the main casing 2. That is, the first inner wall 85R and the second inner wall 85L are disposed spaced apart from each other in the leftward/rightward direction so as to sandwich therebetween the exposure unit 11, the drawer 15 supporting the process cartridges 14, and the transfer unit 12.

The first inner wall 85R has a substantially rectangular plate shape in a side view extending in the forward/rearward direction and includes a concave part 85A and four insertion holes 85B.

The concave part 85A is disposed at an upper portion of the first inner wall 85R. The concave part 85A has a substantially concave shape in a front view opened rightward and recessed leftward from a right surface of the first inner wall 85R. The concave part 85A extends over the entire area of the first inner wall 85R in the front-right direction.

The four insertion holes 85B are disposed spaced apart from one another in the forward/rearward direction as illustrated in FIG. 6 at a part of the upper portion of the first inner wall 85R that is below the concave part 85A.

Each insertion hole 85B has a substantially circular shape in a side view and penetrates the first inner wall 85R in the leftward/rightward direction.

In a state where the drawer 15 supporting the process cartridges 14 is situated at the internal position, each insertion hole 85B faces the coupling concave part 21 of the corresponding photosensitive drum 18 in the leftward/rightward direction.

As illustrated in FIG. 4, the second inner wall 85L has a substantially rectangular plate shape in a side view extending in the forward/rearward direction and includes a concave part 85A. The concave part 85A of the second inner wall 85L has the same configuration as that of the concave part 85A of the first inner wall 85R except that the left and right sides thereof are reversed.

(2) Connecting Plate

The connecting plate 88 is disposed between the exposure unit 11 and the process cartridge 14 in the vertical direction, and bridges between a lower portion of the first inner wall 85R and a lower portion of the second inner wall 85L in the leftward/rightward direction. A lower surface of the connecting plate 88 is connected to an upper end portion of the exposure unit 11.

The connecting plate 88 is formed of a metal and has a substantially rectangular plate shape in a plan view. As illustrated in FIG. 1, the connecting plate 88 has four laser passing holes 90.

The four laser passing holes 90 are disposed spaced apart from one another in the forward/rearward direction. Each laser passing hole 90 penetrates the connecting plate 88 in the vertical direction and has a shape and a size allowing a laser beam to pass therethrough.

(3) Positioning Member

As illustrated in FIG. 4, the first positioning member 89R is disposed at the right end portion of the main casing 2. The second positioning member 89L is disposed at the left end portion of the main casing 2. That is, the first positioning member 89R and the second positioning member 89L are disposed on an upper surface of the connecting plate 88, spaced apart from each other in the leftward/rightward direction so as to sandwich the drawer 15 therebetween.

The first positioning member 89R is disposed below the engagement part 52 of the first side wall 48R. That is, the first positioning member 89R is disposed at the exposure unit 11 side relative to the second part 20B of the first flange 20R of the photosensitive drum 18.

The first positioning member 89R is formed of a metal and is in a plate shape having a substantially L-shape in a front view. The first positioning member 89R extends in the forward/rearward direction. More in detail, the first positioning member 89R integrally includes a body part 89A and a connecting part 89B.

The body part 89A has a substantially rectangular plate shape in a side view extending in the forward/rearward direction and is disposed leftward of the first inner wall 85R, spaced apart therefrom. As illustrated in FIGS. 4 and 12, the body part 89A includes four positioning concave parts 93.

As illustrated in FIG. 12, the four positioning concave parts 93 are disposed on an upper end portion of the body part 89A, spaced apart from one another in the forward/rearward direction. Each positioning concave part 93 has a substantially trapezoidal shape in a side view whose width is reduced toward the bottom and recessed downward from the upper end edge of the body part 89A. The positioning concave part 93 has a shape following an outer peripheral surface of the engagement part 52.

As illustrated in FIG. 4, the connecting part 89B is positioned at a lower end portion of the first positioning member 89R. The connecting part 89B is continued from a lower end portion of the body part 89A and protrudes leftward. The connecting part 89B has a substantially rectangular plate shape in a plan view extending in the forward/rearward direction.

The second positioning member 89L has the same configuration as that of the first positioning member 89R except that the left and right sides thereof are reversed. That is, the first positioning member 89R and the second positioning member 89L are configured such that the four positioning concave parts 93 of the first positioning member 89R and four positioning concave parts 93 of the second positioning member 89L coincide with each other as viewed in the leftward/rightward direction.

The first positioning member 89R is supported by the connecting plate 88 with the connecting part 89B connected to a right end portion of the connecting plate 88. The second positioning member 89L is supported by the connecting plate 88 with the connecting part 89B connected to a left end portion of the connecting plate 88. That is, the first positioning member 89R, the second positioning member 89L, and the exposure unit 11 are connected through the connecting plate 88.

In a state where the process cartridge 14 is situated at the engagement position, the positioning concave part 93 receives a lower end portion of the engagement part 52 of the process cartridge 14, and contacts from below the lower end portion of the engagement part 52. As a result, the second part 20B of the first flange 20R is engaged with the positioning concave part 93 of the first positioning member 89R through the engagement part 52, and the second part 20B of the second flange 20L is engaged with the positioning concave part 93 of the second positioning member 89L through the engagement part 52. The photosensitive drum 18 is positioned by the first positioning member 89R and the second positioning member 89L.

(4) Guide Rail

The first guide rail 94R is disposed at the right end portion of the main casing 2. The second guide rail 94L is disposed at the left end portion of the main casing 2. That is, the first guide rail 94R and the second guide rail 94L are disposed spaced part from each other in the leftward/rightward direction and coincide with each other as viewed in the leftward/rightward direction.

The first guide rail 94R is fixed to a left surface of the body part 89A of the first positioning member 89R so that the first guide rail 94R is disposed below the engagement part 52 of the first side wall 48R of the process cartridge 14 and spaced apart from the engagement part 52.

The first guide rail 94R has a substantially rectangular columnar shape extending in the forward/rearward direction and includes a guide groove 95 and two guide rollers 96.

The guide groove 95 has a substantially concave shape opened leftward and recessed rightward from a left surface of the guide rail 94. As illustrated in FIG. 1, the guide groove 95 extends over substantially the entire area of the first guide rail 94R in the front-right direction. A rear end portion of the guide groove 95 is closed, while a front end portion thereof is opened.

The two guide rollers 96 are disposed to be aligned in the forward/rearward direction on a lower surface of the front end portion of the guide groove 95. Each guide roller 96 is rotatable about its axis extending in the leftward/rightward direction. An upper end portion of each guide roller 96 is exposed from a lower surface of the guide groove 95.

The guide groove 95 of the first guide rail 94R receives a right end portion of the first side frame 68R of the drawer 15 so as to allow the right end portion of the first side frame 68R to slide in the forward/rearward direction.

The second guide rail 94L has the same configuration as that of the first guide rail 94R except that the left and right sides thereof are reversed.

5. Drive Unit and Power Supply Unit

The image forming section 3 includes a drive unit 8 and a power supply unit 9.

(1) Drive Unit

The drive unit 8 is configured to input a drive force to the four photosensitive drums 18 and disposed on a right surface of the first inner wall 85R as illustrated in FIG. 4. As illustrated in FIG. 6, the drive unit 8 includes a frame 86, a drive cam 99, four drive input members 98, and a compression spring 100.

Figure 11:
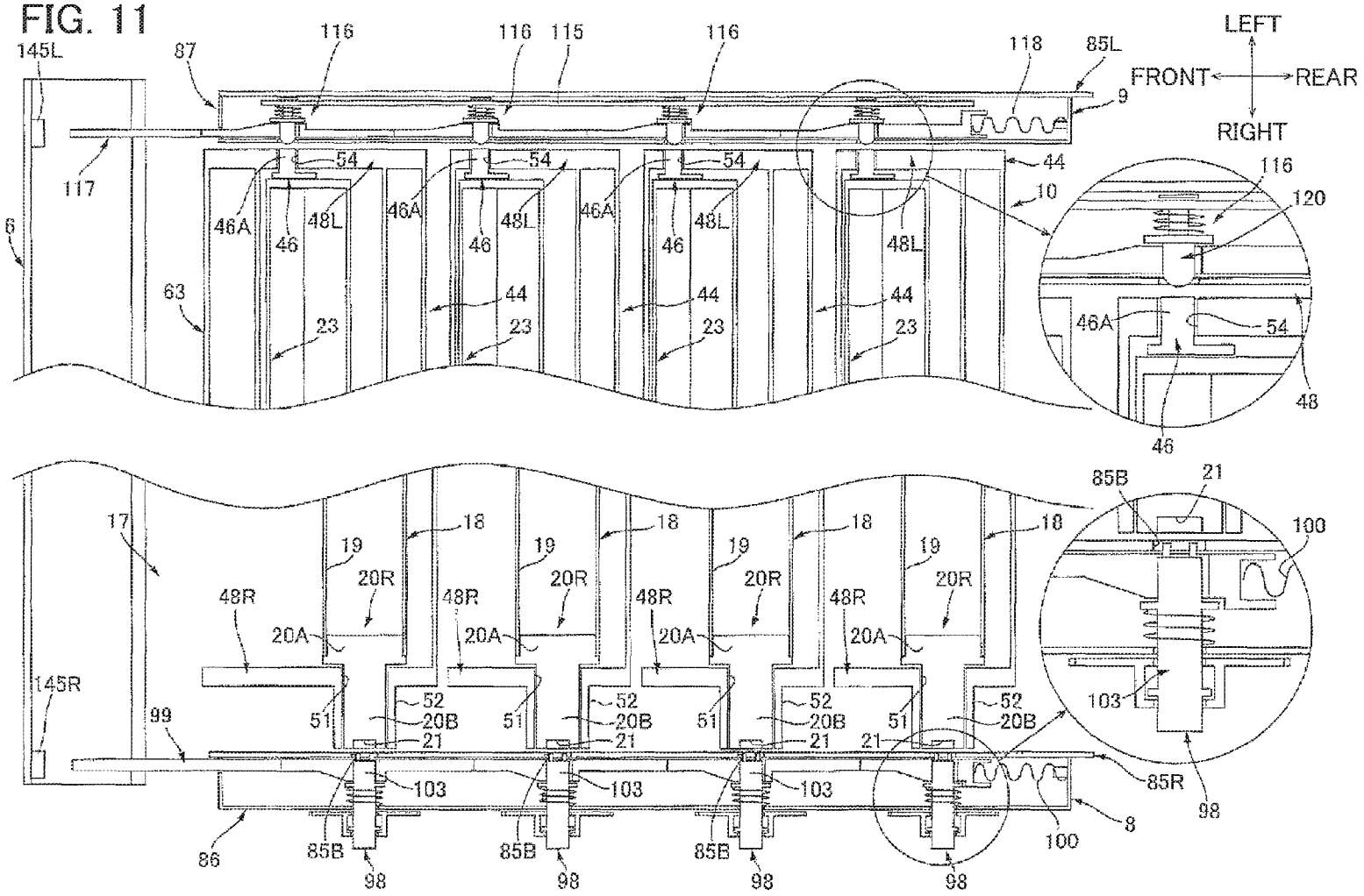
FIG. 11 is a cross-sectional view of the image forming apparatus shown in FIG. 7 and taken along a line corresponding to the line C-C of FIG. 4.

The frame 86 is supported by the first inner wall 85R. The drive cam 99 is housed in the frame 86. The drive cam 99 is movable in the forward/rearward direction between: a pressing position (see FIG. 11) at which the drive cam 99 presses the four drive input members 98 rightward; and a pressing release position (see FIG. 6) at which the drive cam 99 releases pressing against the four drive input members 98. In a state where the front cover 6 is situated at the closed position, the drive cam 99 is abutted, at its front end portion, against a first cam abutment part 145R (to be described later) of the front cover 6 to be pressed rearward and to be situated at the pressing release position.

Each drive input member 98 includes a drive coupling 103. The drive coupling 103 is movable in the leftward/rightward direction between: a drive transmission position (see FIG. 6) at which the drive coupling 103 is engaged with the coupling concave part 21 of the corresponding photosensitive drum 18; and a drive transmission release position (see FIG. 11) at which the engagement with the coupling concave part 21 of the corresponding photosensitive drum 18 is released. The compression spring 100 always biases the drive cam 99 forward toward the pressing position.

(2) Power Supply Unit

The power supply unit 9 is configured to supply electric power to the four developing units 29 and is disposed on a right surface of the second inner wall 85L. As illustrated in FIG. 6, the power supply unit 9 includes a frame 87, a board 115, a power supply cam 117, four power supply members 116, and a compression spring 118.

The frame 87 is supported by the second inner wall 85L. The board 115 is configured to supply power to the four power supply members 116. The power supply cam 117 is movable in the forward/rearward direction between: a pressing position (see FIG. 11) at which the power supply cam 117 presses leftward the power supply members 116; and a pressing release position (see FIG. 6) at which the power supply cam 117 releases pressing against the power supply members 116. In a state where the front cover 6 is situated at the closed position, the power supply cam 117 is abutted, at its front end portion, against a second cam abutment part 145L (to be described later) of the front cover 6 to be pressed rearward and to be situated at the pressing release position.

Each power supply member 116 includes a main electrode 120. The main electrode 120 is movable in the leftward/rightward direction between: an energization position (see FIG. 6) at which the main electrode 120 contacts the electrical contact part 46A of the developing unit 29; and an energization release position (see FIG. 11) at which the contact with the electrical contact part 46A of the developing unit 29 is released. The compression spring 118 always biases the power supply cam 117 forward toward the pressing position.

6. Belt Unit and Front Cover

As illustrated in FIG. 4, the belt unit 30 includes a belt frame 130. The belt frame 130 includes a first side wall 133R and a second side wall 133L. The first side wall 133R is disposed at a right end portion of the belt frame 130. The second side wall 133L is disposed at a left end portion of the belt frame 130. That is, the first side wall 133R and second side wall 133L are disposed spaced apart from each other in the leftward/rightward direction.

The first side wall 133R and the second side wall 133L each have a substantially rectangular plate shape in a side view extending in the forward/rearward direction. The belt frame 130 supports the drive roller 32, the follower roller 33, the intermediate transfer belt 34, the four primary transfer rollers 35, and the opposing roller 36 in an area between the first side wall 133R and the second side wall 133L.

As illustrated in FIGS. 1 and 6, the front cover 6 has a substantially rectangular plate shape in front view extending in both of the vertical direction (upward/leftward direction) and the leftward/rightward directions. The front cover 6 includes the first cam abutment part 145R, a second cam abutment part 145L, the first pressing/abutment part 146R, a second pressing/abutment part 146L, a first drawer abutment part 147R, and a second drawer abutment part 147L.

As illustrated in FIG. 6, the first cam abutment part 145R and the second cam abutment part 145L are disposed spaced apart from each other in the leftward/rightward direction at a substantial center, in the vertical direction, of a rear surface of the front cover 6. The first cam abutment part 145R and the second cam abutment part 145L each have a substantially trapezoidal shape in a side view whose width is reduced toward the rear and protruding rearward from the front cover 6.

As illustrated in FIGS. 1 and 5, the first pressing/abutment part 146R and second pressing/abutment part 146L are disposed spaced apart from each other in the leftward/rightward direction at an upper portion of the rear surface of the front cover 6. The first pressing/abutment part 146R and second pressing/abutment part 146L each have a substantially trapezoidal shape in a side view whose width is reduced toward the rear and protruding rearward from the front cover 6.

The first drawer abutment part 147R and the second drawer abutment part 147L are disposed spaced apart from each other in the leftward/rightward direction at a substantial center portion, in the vertical direction, of the rear surface of the front cover 6. The first drawer abutment part 147R and the second drawer abutment part 147L protrude from the front cover 6 with their widths gradually becoming smaller toward the rear side.

Although described in detail later, the front cover 6 also supports third and fourth connecting parts 150R and 150L of an interlocking mechanism 148.

7. Pressing Mechanism

Figure 3:
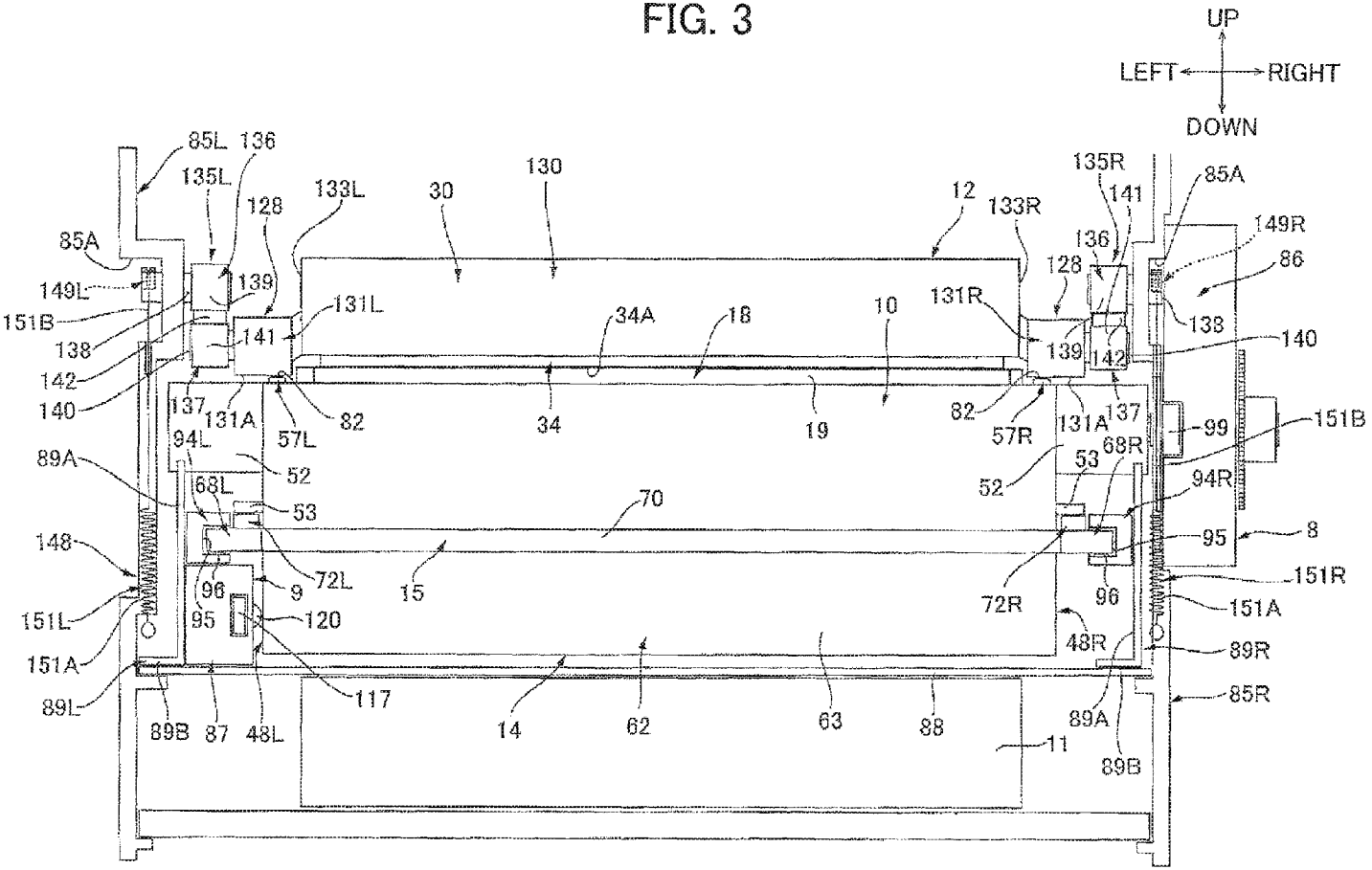
FIG. 3 is a front view of the image forming apparatus, from which the front cover is omitted.

As illustrated in FIG. 3, the image forming apparatus 1 includes a pressing mechanism 128 and an interlocking mechanism 148.

The pressing mechanism 128 is configured to press the first and second pressing units 57R and 57L of each of the four process cartridges 14 and includes a first pressing member 131R, a second pressing member 131L, two first turning units 135R and two second turning units 135L.

(1) Pressing Member

The first pressing member 131R and the second pressing member 131L are provided inside the main casing 2 and disposed spaced apart from each other in the leftward/rightward direction so as to sandwich the belt unit 30 therebetween. The first pressing member 131R is disposed rightward of the first side wall 133R of the belt unit 30, and an upper portion of the first pressing member 131R is connected to a lower portion of a right surface of the first side wall 133R. The second pressing member 131L is disposed leftward of the second side wall 133L of the belt unit 30, and an upper portion of the second pressing member 131L is connected to a lower portion of a left surface of the second side wall 133L. With this configuration, the first pressing member 131R and the second pressing member 131L are integrally formed with the belt frame 130.

As illustrated in FIG. 5, the first pressing member 131R and the second pressing member 131L each have a substantially bar shape extending in the forward/rearward direction, more specifically, a substantially rectangular columnar shape extending in the forward/rearward direction.

As illustrated in FIG. 10, a front end portion of each of the first pressing member 131R and the second pressing member 131L is disposed slightly forward of a front end portion of the first side wall 133R of the belt unit 30. As illustrated in FIG. 3, a lower surface of each of the first pressing member 131R and the second pressing member 131L is configured as an abutment surface 131A. The abutment surface 131A is disposed below the transfer surface 34A of the intermediate transfer belt 34. In other words, the abutment surface 131A is disposed on the process cartridge 14 side relative to the transfer surface 34A so that the abutment surface 131A is closer to the exposure unit 11 than the transfer surface 34A is to the exposure unit 11.

(2) Turning Unit

The two turning units 135R are disposed rightward of the first pressing member 131R. The two turning units 135L are disposed leftward of the second pressing member 131L. That is, the belt unit 30, the first pressing member 131R, the second pressing member 131L, the two first turning units 135R, and the two second turning units 135L are arranged side by side in the leftward/rightward direction.

The front one of the two first turning units 135R is disposed so as to correspond to a front end portion of the first pressing member 131R, and the rear one of the two first turning units 135R is disposed so as to correspond to a rear end portion of the first pressing member 131R. That is, the two first turning units 135R are disposed spaced apart from each other in the forward/rearward direction. As illustrated in FIGS. 3 and 5, each first turning unit 135R includes a support point part 136 and a pressing connecting part 137.

The support point part 136 is disposed leftward of the concave part 85A of the first inner wall 85R and includes a support point shaft 138 and a first cylindrical part 139. The support point shaft 138 has a substantially columnar shape extending in the leftward/rightward direction. The support point shaft 138 is rotatably supported by the first inner wall 85R so as to protrude leftward from the concave part 85A of the first inner wall 85R. The first cylindrical part 139 has a substantially cylindrical shape extending in the leftward/rightward direction. The first cylindrical part 139 is attached to the support point shaft 138 at its portion leftward of the first inner wall 85R so as not to be rotatable relative to the support point shaft 138.

The pressing connecting part 137 connects the support point part 136 and the first pressing member 131R and is disposed below the support point part 136. The pressing connecting part 137 includes a connecting shaft 140, a second cylindrical part 141, and a continuous part 142. The connecting shaft 140 has a substantially columnar shape extending in the leftward/rightward direction. The connecting shaft 140 is rotatably attached to the first pressing member 131R so as to protrude rightward from a right surface of the first pressing member 131R. The second cylindrical part 141 has a substantially cylindrical shape extending in the leftward/rightward direction and is attached to the connecting shaft 140 so as not to be rotatable relative to the connecting shaft 140. The continuous part 142 connects the first cylindrical part 139 and the second cylindrical part 141. More specifically, the continuous part 142 extends upward from an upper end portion of the second cylindrical part 141 and is connected to a lower end portion of the first cylindrical part 139.

The second turning unit 135L has the same configuration as that of the first turning unit 135R except that the left and right sides thereof are reversed.

The support point shaft 138 of the front one of the two first turning units 135R penetrates the first inner wall 85R in the leftward/rightward direction. The support point shaft 138 of the front one of the two second turning units 135L penetrates the second inner wall 85L in the leftward/rightward direction. A right side portion of the support point shaft 138 that penetrates the first inner wall 85R is disposed in the concave part 85A. Further, the right side portion of the support point shaft 138 disposed in the concave part 85A supports a first connecting part 149R (to be described later) of the interlocking mechanism 148. A left side portion of the support point shaft 138 that penetrates the second inner wall 85L is disposed in the concave part 85A. Further, the left side portion of the support point shaft 138 disposed in the concave part 85A supports a second connecting part 149L (to be described later) of the interlocking mechanism 148.

(3) Operation of Pressing Mechanism

The first pressing member 131R, the second pressing member 131L, and the belt unit 30 are configured to be integrally movable by the two first turning units 135R and the two second turning units 135L.

More in detail, the first pressing member 131R is configured to be movable between: an abutment position (see FIG. 5) at which the first pressing member 131R abuts against the first pressing units 57R of the process cartridges 14 from the belt unit 30 side, i.e., from above; and an abutment release position (see FIG. 10) at which the abutment against the first pressing units 57R is released. The second pressing member 131L is configured to be movable between: an abutment position (see FIG. 5) at which the second pressing member 131L abuts against the second pressing units 57L of the process cartridges 14 from the belt unit 30 side, i.e., from above; and an abutment release position (see FIG. 10) at which the abutment against the second pressing units 57L is released.

Being interlocked with the movements of the first pressing member 131R and the second pressing member 131L from the abutment position to abutment release position, the belt unit 30 is moved: from a contact position (see FIG. 1) at which the transfer surface 34A of the intermediate transfer belt 34 contacts the four photosensitive drums 18; to a separated position (see FIG. 7) at which the transfer surface 34A of the intermediate transfer belt 34 is separated from the four photosensitive drums 18. On the other hand, being interlocked with the movements of the first pressing member 131R and the second pressing member 131L from the abutment release position to abutment position, the belt unit 30 is moved from the separated position (see FIG. 7) to the contact position (see FIG. 1). That is, the belt unit 30 is configured to move between the contact position (see FIG. 1) and the separated position (see FIG. 7).

As illustrated in FIG. 5, in a state where the front cover 6 is situated at the closed position, the first pressing member 131R is abutted, at the front end portion thereof, on the first pressing abutment part 146R to be pressed rearward and to be situated at the abutment position. Further, as illustrated in FIG. 1, in a state where the front cover 6 is situated at the closed position, the second pressing member 131L is abutted, at the front end portion thereof, on the second pressing abutment part 146L to be pressed rearward and to be situated at the abutment position. As a result, in a state where the front cover 6 is situated at the closed position, the belt unit 30 is situated at the contact position.

8. Interlocking Mechanism

Although described in detail later, the interlocking mechanism 148 is configured to interlock the movement of the front cover 6 with the movement of the first and second pressing members 131R and 131L. The interlocking mechanism 148 includes the first connecting part 149R, the second connecting part 149L, a third connecting part 150R, a fourth connecting part 150L, a first connecting member 151R and a second connecting member 151L.

As illustrated in FIG. 3, the first connecting part 149R is provided to the front one of the two first turning units 135R. The second connecting part 149L is provided to the front one of the two second turning units 135L.

As illustrated in FIGS. 3 and 5, the first connecting part 149R is disposed rearward of the right side portion of the support point shaft 138 that is disposed in the concave part 85A of the first inner wall 85R. The first connecting part 149R has a substantially rectangular plate shape in a side view and extends rearward from the right side portion of the support point shaft 138. That is, in terms of a peripheral direction of the support point shaft 138, the first connecting part 149R is disposed spaced apart from the continuous part 142 by substantially 90 degrees in a counterclockwise direction as viewed from the right side.

The second connecting part 149L has the same configuration as that of the first connecting part 149R except that the left and right sides thereof are reversed.

As illustrated in FIGS. 1 and 5, the third and fourth connecting parts 150R and 150L are provided to the front cover 6. The third and fourth connecting parts 150R and 150L are disposed on the rear surface of the front cover 6 at positions below the first and second drawer abutment parts 147R and 147L, respectively, spaced apart from each other in the leftward/rightward direction. The third and fourth connecting parts 150R and 150L each have a substantially rectangular plate shape in a side view and each protrude rearward from the rear surface of the front cover 6.

As illustrated in FIGS. 3 and 5, the first and second connecting members 151R and 151L are disposed spaced apart from each other in the leftward/rightward direction. The first connecting member 151R is formed of a wire material and extends in a direction connecting the lower front side to upper rear side. The first connecting member 151R includes a coil part 151A and a linear part 151B.

The coil part 151A constitutes a lower front portion of the first connecting member 151R and has a coil shape wherein the wire material is helically wound. The linear part 151B constitutes an upper rear portion of the first connecting member 151R. The linear part 151B is continued from an upper end portion of the coil part 151A and linearly extends in the upper rear direction.

An upper rear end portion of the first connecting member 151R is engaged to a rear end portion of the first connecting part 149R, and a lower front end portion of the first connecting member 151R is engaged to a rear end portion of the third connecting part 150R.

The second connecting member 151L has the same configuration as that of the first connecting member 151R except that the left and right sides thereof are reversed.

9. Detachment Operation and Attachment Operation of Process Cartridge

(1) Detachment Operation

Detachment operation of the process cartridge 14 is described.

As illustrated in FIGS. 5 and 10, when a user desires to detach the process cartridge 14 from the main casing 2, the front cover 6 is moved from the closed position toward the open position. As a result, abutment between the first pressing member 131R and the first pressing abutment part 146R and abutment between the second pressing member 131L and the second pressing abutment part 146L are released. At the same time, in association with the movement of the front cover 6, the third and fourth connecting parts 150R and 150L of the interlocking mechanism 148 are moved in the lower front direction. As a result, the coil part 151A of the first connecting member 151R and the coil part 151A of the second connecting member 151L are extended to become longer than the natural lengths thereof.

Figure 7:
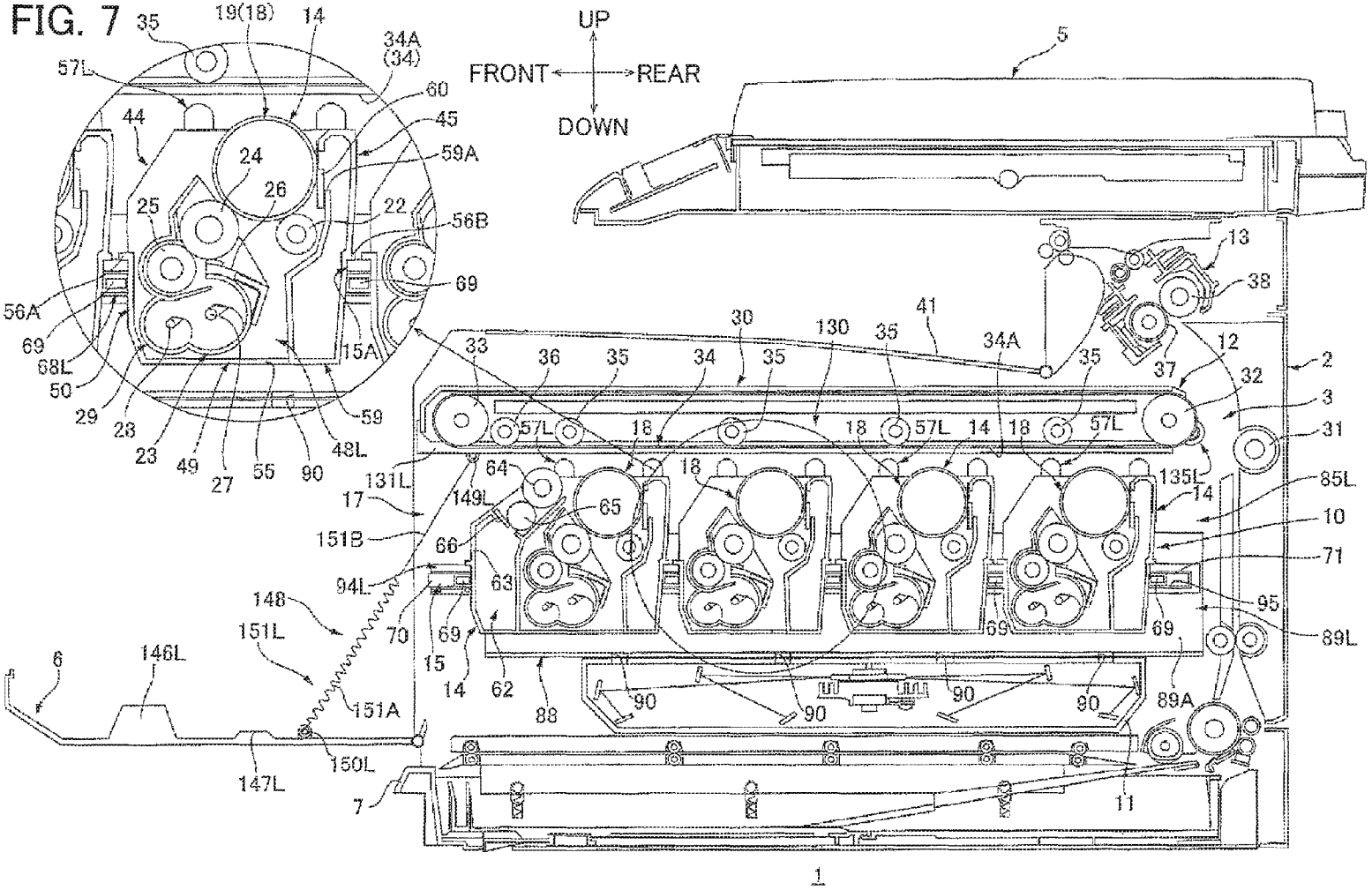
FIG. 7 is a cross-sectional side view of the image forming apparatus, according to the first embodiment, taken along the leftward/rightward center thereof, and showing a state where the front cover is at its open position and the drawer is at its internal position.
Figure 8:
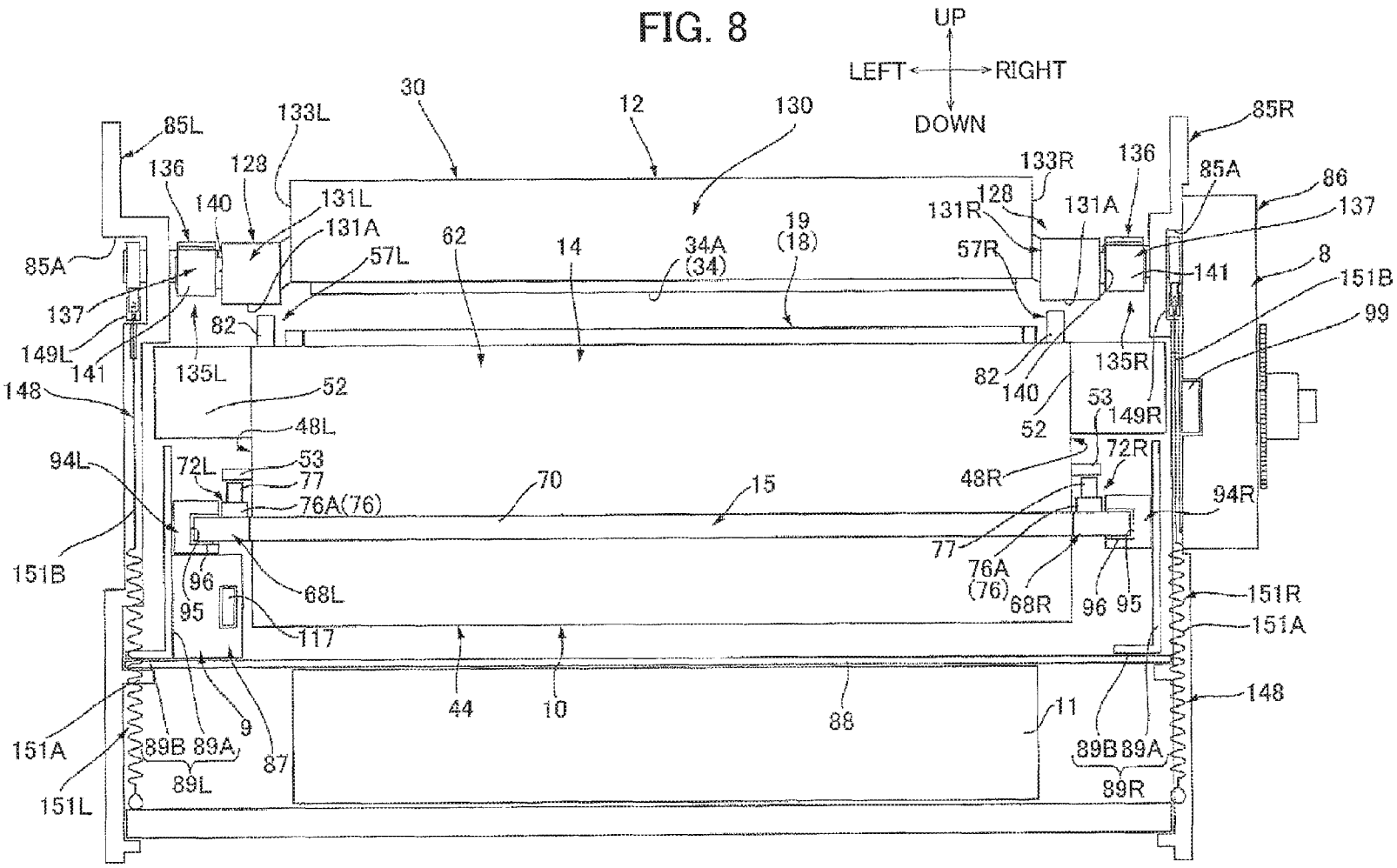
FIG. 8 is a front view of the image forming apparatus shown in FIG. 7, from which the front cover is omitted.

When the front cover 6 reaches the open position, the first connecting part 149R is pulled in the lower front direction by a biasing force of the coil part 151A of the first connecting member 151R, and the second connecting part 149L is pulled in the lower front direction by a biasing force of the coil part 151A of the second connecting member 151L. As a result, the two first turning units 135R and the two second turning units 135L each turn about the support point shaft 138 in a clockwise direction as viewed from the right side by 90 degrees. As a result, the pressing connecting part 137 is moved in the upper front direction and reaches a position forward of the support point part 136 as illustrated in FIG. 10. Accordingly, both the front and rear end portions of the first pressing member 131R are pulled in the upper front direction by the pressing connecting parts 137, and both the front and rear end portions of the second pressing member 131L are pulled in the upper front direction by the pressing connecting parts 137. As a result, the first pressing member 131R is moved in a translational motion in the upper front direction from the abutment position to reach the abutment release position at which the abutment surface 131A is separated from the two abutted parts 82 of the first pressing unit 57R. On the other hand, the second pressing member 131L is moved in a translational motion in the upper front direction from the abutment position to reach the abutment release position at which the abutment surface 131A is separated from the two abutted parts 82 of the second pressing unit 57L. Further, as illustrated in FIG. 7, the belt unit 30 is moved in a translational motion in the upper front direction from the contact position to reach the separated position at which the transfer surface 34A of the intermediate transfer belt 34 is separated from the four photosensitive drums 18.

That is, the first and second pressing members 131R and 131L are moved from the abutment position to the abutment release position as being interlocked with the movement of the front cover 6 from the closed position to the open position. The belt unit 30 is moved from the contact position to the separated position as being interlocked with the movement of the front cover 6 from the closed position to the open position.

Further, as illustrated in FIG. 10, when the first pressing member 131R is moved from the abutment position to the abutment release position, the two abutted parts 82 of the first pressing unit 57R are moved upward from the retracted position to the advanced position by the biasing force of the two biasing members 83 of the first pressing unit 57R. Further, when the second pressing member 131L is moved from the abutment position to the abutment release position, the two abutted parts 82 of the second pressing unit 57L are moved upward from the retracted position to the advanced position by the biasing force of the two biasing members 83 of the second pressing unit 57L.

The contact portion 77A of the advance/retract part 77 of the first biasing part 72R of the drawer 15 biases upward the protruding part 53 of the first side wall 48R of the process cartridge 14 by means of the biasing force of the two biasing members 78. Further, the contact portion 77A of the advance/retract part 77 of the second biasing part 72L biases upward the protruding part 53 of the second side wall 48L of the process cartridge 14 by means of the biasing force of the two biasing members 78. Accordingly, the process cartridge 14 is moved upward from the engagement position to the engagement release position, with the vertical position of the process cartridge 14 in the leftward/rightward direction being kept constant.

At this time, the two restricting portions 77B of the advance/retract part 77 are guided by the frame part 76A, and then upward movement of the restricting portions 77B is restricted by the two restricting projections 76B. Accordingly, the moving amount, by which the contact portion 77A of the advance/retract part 77 moves to push the process cartridge 14 from the engagement position to the engagement release position, becomes constant in the forward/rearward direction.

Figure 9:
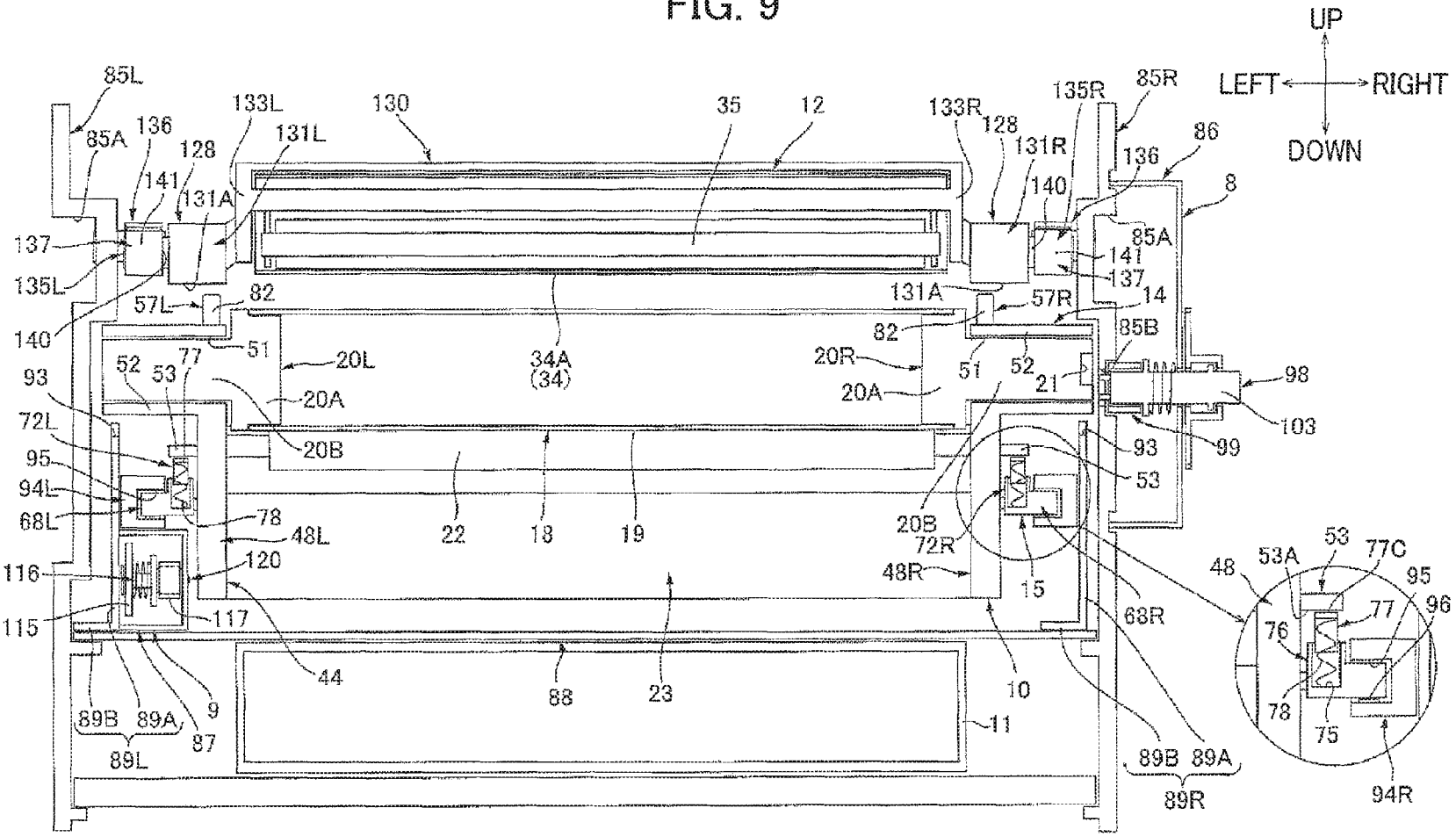
FIG. 9 is a cross-sectional view of the image forming apparatus shown in FIG. 7 and taken along a line corresponding to the line A-A of FIG. 1.

When the process cartridge 14 reaches the engagement release position, the engagement part 52 is separated upward from the positioning concave part 93 as illustrated in FIG. 9. As a result, engagement between the first flange 20R of the photosensitive drum 18 and the positioning concave part 93 of the first positioning member 89R through the engagement part 52 is released, and engagement between the second flange 20L of the photosensitive drum 18 and the positioning concave part 93 of the second positioning member 89L through the engagement part 52 is released. That is, when the first and second pressing members 131R and 131L are situated at the abutment release position, the contact portion 77A of the advance/retract part 77 moves the process cartridge 14 from the engagement position to engagement release position.

When the first and second pressing members 131R and 131L are situated at the abutment release position, the process cartridge 14 is situated at the engagement release position, and the abutted part 82 is situated in the advanced position, the first pressing member 131R and the two abutted parts 82 of the first pressing unit 57R are separated from each other in the vertical direction, and the second pressing member 131L and the two abutted parts 82 of the second pressing unit 57L are separated from each other in the vertical direction.

That is, a moving amount of each of the first and second pressing members 131R and 131L in the vertical direction from the abutment position to the abutment release position is larger than a total sum of a moving amount of the process cartridge 14 from the engagement position to the engagement release position and a moving amount of the abutted part 82 from the retracted position to the advanced position.

Then, as illustrated in FIG. 12, the drawer 15 supporting the process cartridge 14 is pulled forward from the main casing 2 by a user. The drawer 15 is moved, with the first and second side frames 68R and 68L of the drawer 15 being guided by the first and second guide rails 94R and 94L, respectively. After the drawer 15 reaches the external position, the process cartridge 14 is separated, by the user, upward from the drawer 15 in the separating direction X, as indicated by dotted lines of FIG. 12.

As a result, detachment of the process cartridge from the main casing 2 is completed.

(2) Attachment Operation

Attachment operation of the process cartridge 14 is described.

When desiring to attach the process cartridge 14 to the main casing 2, the process cartridge 14 is inserted by the user from above into the insertion opening 15A of the drawer 15. As a result, the process cartridge 14 is supported by the drawer 15.

Subsequently, as illustrated in FIGS. 5 and 10, the drawer 15 supporting the process cartridge 14 is pushed into the main casing 2. The drawer 15 is moved, with the first and second side frames 68R and 68L of the drawer 15 being guided by the first and second guide rails 94R and 94L, respectively. After the drawer 15 reaches the internal position, the front cover 6 is moved from the open position to the closed position.

As a result, the coil part 151A of the first connecting member 151R and coil part 151A of the second connecting member 151L are compressed in association with the movement of the front cover 6 toward the closed position. As a result, the first connecting part 149R is pressed in the upper rear direction by the biasing force of the coil part 151A of the first connecting member 151R, and the second connecting part 149L is pressed in the upper rear direction by the biasing force of the coil part 151A of the second connecting member 151L. Further, the first pressing abutment part 146R of the front cover 6 abuts against the front end portion of the first pressing member 131R to press the first pressing member 131R rearward, and the second pressing abutment part 146L abuts against the front end portion of the second pressing member 131L to press the second pressing member 131L rearward.

This causes the two first turning units 135R and the two second turning units 135L to turn about the corresponding support point shafts 138, respectively, by about 90 degrees in the counterclockwise direction as viewed from the right side. As a result, the pressing connecting part 137 is moved in the rear lower direction and reaches a position below the support point part 136, as illustrated in FIG. 5.

As a result, the first and second pressing members 131R and 131L are pressed in the lower rear direction by the corresponding pressing connecting parts 137, respectively, to be moved in a translational motion from the abutment release position to the abutment position. That is, the first and second pressing members 131R and 131L are moved from the abutment release position to the abutment position as being interlocked with the movement of the front cover 6 from the open position toward the closed position.

When the first pressing member 131R thus reaches the abutment position, a left side portion of the abutment surface 131A of the first pressing member 131R abuts against, from above, the circular arc parts 82B of the two abutted parts 82 of the first pressing unit 57R, as illustrated in FIG. 4. Further, a right side portion of the abutment surface 131A of the second pressing member 131L abuts against, from above, the circular arc parts 82B of the two abutted parts 82 of the second pressing unit 57L. That is, the two abutted parts 82 of the first pressing unit 57R are positioned leftward of the right surface of the first pressing member 131R, and the two abutted parts 82 of the second pressing unit 57L are positioned rightward of the left surface of the second pressing member 131L.

The first pressing member 131R presses downward the two abutted parts 82 of the first pressing unit 57R, and the second pressing member 131L presses downward the two abutted parts 82 of the second pressing unit 57L. As a result, the abutted parts 82 are moved downward from the advanced position to the retracted position so as to be separated from the belt unit 30.

As a result, as illustrated in FIG. 5, the biasing members 83 are further compressed to bias the bottom walls of the support frames 81 downward. As a result, the process cartridge 14 is moved downward from the engagement release position to the engagement position against the biasing force of the two biasing members 78 of the first biasing part 72R and the two biasing members 78 of the second biasing part 72L. That is, when the first and second pressing members 131R and 131L are situated at the abutment position, the process cartridge 14 is disposed at the engagement position.

When the process cartridge 14 reaches the engagement position, the engagement part 52 of the first side wall 48R is engaged with the positioning concave part 93 of the first positioning member 89R from above as illustrated in FIG. 4, and engagement part 52 of the second side wall 48L is engaged with the positioning concave part 93 of the second positioning member 89L from above. That is, when the two abutted parts 82 of the first pressing unit 57R are abutted by the first pressing member 131R and pressed by the first pressing member 131R, the two biasing members 83 of the first pressing unit 57R bias, toward the positioning concave part 93 of the first positioning member 89R, the engagement part 52 of the first side wall 48R and the first flange 20R of the photosensitive drum 18. Further, when the two abutted parts 82 of the second pressing unit 57L are abutted by the second pressing member 131L and pressed by the second pressing member 131L, the two biasing members 83 of the second pressing unit 57L bias, toward the positioning concave part 93 of the second positioning member 89L, the engagement part 52 of the second side wall 48L and the second flange 20L of the photosensitive drum 18. As a result, the engagement parts 52 are engaged with the positioning concave parts 93 and are positioned with respect to the first and second positioning members 89R and 89L.

Thus, the first flange 20R of the photosensitive drum 18 is engaged with the positioning concave part 93 through the engagement part 52, thereby being positioned with respect to the first positioning member 89R. Further, the second flange 20L is positioned in the same way as the first flange 20R.

Further, as illustrated in FIG. 1, the belt unit 30 is moved in a translational motion in the lower rear direction from the separated position to the contact position in association with movement of the first and second pressing members 131R and 131L from the abutment release position to the abutment position. As a result, the transfer surface 34A of the intermediate transfer belt 34 contacts from above the photosensitive drums 18. That is, the belt unit 30 is moved from the separated position to the contact position as being interlocked with the movement of the front cover 6 from the open position to closed position.

10. Functions and Advantages (1) As illustrated in FIG. 4, in the image forming apparatus 1, the first positioning member 89R is engaged with the first flange 20R of the photosensitive drum 18 through the engagement part 52, and second positioning member 89L is engaged with the second flange 20L through the engagement part 52.

That is, the first positioning member 89R is disposed below the first flange 20R, that is, disposed at the exposure unit 11 side relative to the first flange 20R, and the second positioning member 89L is disposed below the second flange 20L, that is, disposed at the exposure unit 11 side relative to the second flange 20L.

Thus, positioning accuracy between the first and second positioning members 89R and 89L and the exposure unit 11 can be sufficiently improved.

When being situated at the abutment position, the first pressing member 131R abuts against the first pressing unit 57R of the process cartridge 14 from above, that is, from the belt unit 30 side. Further, when being situated at the abutment position, the second pressing member 131L abuts against the second pressing unit 57L of the process cartridge 14 from above, that is, from the belt unit 30 side.

As a result, the first and second pressing members 131R and 131L press downward the process cartridge 14, thereby allowing reliable engagement between the first flange 20R of the photosensitive drum 18 and the first positioning member 89R through the engagement part 52 and reliable engagement between the second flange 20L of the photosensitive drum 18 and the second positioning member 89L through the engagement part 52.

As a result, the photosensitive drum 18 can be exposed to light with high accuracy to thereby allow image formation accuracy to be improved.

Further, as illustrated in FIG. 7, by disposing the belt unit 30 at the separated position, the intermediate transfer belt 34 and the photosensitive drum 18 can be separated from each other. In addition, as illustrated in FIG. 10, by disposing the first and second pressing members 131R and 131L at the abutment release position, abutment between the first pressing member 131R and the first pressing unit 57R is released, and abutment between the second pressing member 131L and the second pressing unit 57L is released.

This allows the drawer 15 supporting the process cartridge 14 to be smoothly moved between the internal and external positions as illustrated in FIG. 12, thereby allowing maintainability for the process cartridge 14 to be improved.

(2) As illustrated in FIG. 9, when the first and second pressing members 131R and 131L are situated at the abutment release position, the process cartridge 14 is disposed at the engagement release position. That is, when abutment between the first and second pressing members 131R and 131L and the process cartridge 14 is released, engagement between the photosensitive drum 18 and the first and second positioning members 89R and 89L is released.

As illustrated in FIG. 12, the first and second pressing members 131R and 131L are disposed at the abutment release position when the drawer 15 supporting the process cartridge 14 is moved. Accordingly, interference between the process cartridge 14 and the first and second positioning members 89R and 89L can be prevented. This can ensure more smooth movement of the drawer 15 supporting the process cartridge 14.

(3) As illustrated in FIG. 9, the first and second biasing parts 72R and 72L bias upward, that is, toward the belt unit 30 side, the process cartridge 14 supported by the drawer 15. Thus, when the first and second pressing members 131R and 131L are situated at the abutment release position, the process cartridge 14 supported by the drawer 15 can be reliably disposed at the engagement release position.

(4) As illustrated in FIG. 2A, the first and second biasing parts 72R and 72L are provided on the drawer 15. Thus, efficient layout of the first and second biasing parts 72R and 72L can be ensured even with a simple configuration. As a result, as illustrated in FIG. 10, the process cartridge 14 supported by the drawer 15 can be biased reliably.

(5) As illustrated in FIGS. 5 and 10, the first and second biasing parts 72R and 72L each include the advance/retract part 77 that advances and retracts in the vertical direction. The advance/retract part 77 includes the contact portion 77A and the two restricting portions 77B. The two restricting portions 77B restrict movement of the advance/retract part 77 such that a moving amount of the contact portion 77A is constant in the forward/rearward direction. Thus, when the contact portion 77A moves the process cartridge 14 from the engagement position to the engagement release position, inclination of the process cartridge 14 in the forward/rearward direction can be prevented. This allows the process cartridge 14 to be stably moved from the engagement position to the engagement release position.

(6) As illustrated in FIGS. 4 and 5, when the abutted part 82 of the first pressing unit 57R is abutted by the first pressing member 131R, the biasing member 83 of the first pressing unit 57R biases the first flange 20R of the photosensitive drum 18, toward the first positioning member 89R. Further, when the abutted part 82 of the second pressing unit 57L is abutted by the second pressing member 131L, the biasing member 83 of the second pressing unit 57L biases the second flange 20L of the photosensitive drum 18 toward the second positioning member 89L.

Thus, when the first and second pressing members 131R and 131L are situated at the abutment position, the photosensitive drum 18 can be engaged with the first and second positioning members 89R and 89L more reliably.

(7) As illustrated in FIG. 10, the moving amount of the first pressing member 131R from the abutment position to the abutment release position is larger than the total sum of the moving amount of the process cartridge 14 from the engagement position to the engagement release position and moving amount of the abutted part 82 of the first pressing unit 57R from the retracted position to the advanced position. Thus, when the first pressing member 131R is situated at the abutment release position, the first pressing member 131R and the abutted part 82 of the first pressing unit 57R can be reliably separated from each other. As a result, as illustrated in FIG. 12, when the drawer 15 supporting the process cartridge 14 is moved, interference between the first pressing member 131R and the abutted part 82 of the first pressing unit 57R can be reliably prevented.

(8) As illustrated in FIG. 2B, the first pressing unit 57R includes the two pressed parts 57R2 which are disposed spaced apart from each other in the forward/rearward direction so as to sandwich the photosensitive drum 18 therebetween as viewed in the leftward/rightward direction. Further, as illustrated in FIG. 2C, the second pressing unit 57L includes the two pressed parts 57L2 which are disposed spaced apart from each other in the forward/rearward direction so as to sandwich the photosensitive drum 18 therebetween as viewed in the leftward/rightward direction.

Thus, as illustrated in FIG. 5, when being situated at the abutment position, the first pressing member 131R presses the two pressed parts 57R2 which are disposed at the right end portion of the process cartridge 14 so as to sandwich the photosensitive drum 18 therebetween. Further, when being situated at the abutment position, the second pressing member 131L presses the two pressed parts 57L2 which are disposed at the left end portion of the process cartridge 14 so as to sandwich the photosensitive drum 18 therebetween.

As a result, the right end portion of the photosensitive drum 18 can be reliably engaged with the first positioning member 89R through the engagement part 52, and the left end portion of the photosensitive drum 18 can be reliably engaged with the second positioning member 89L through the engagement part 52.

(9) As illustrated in FIGS. 5 and 10, the first and second pressing members 131R and 131L and the belt unit 30 interlock with each other. Thus, when the first and second pressing members 131R and 131L are situated at the abutment position, the belt unit 30 can be reliably disposed at the contact position; while when the first and second pressing members 131R and 131L are situated at the abutment release position, the belt unit 30 can be reliably disposed at the separated position.

(10) As illustrated in FIG. 3, the first pressing member 131R is connected to the first side wall 133R of the belt unit 30, and the second pressing member 131L is connected to the second side wall 133L of the belt unit 30. That is, the first and second pressing members 131R and 131L are integrally formed with the belt unit 30. Thus, the first and second pressing members 131R and 131L and belt unit 30 can be made to interlock with each other reliably.

(11) As illustrated in FIG. 3, the first and second pressing members 131R and 131L are arranged in the leftward/rightward direction with the belt unit 30 interposed therebetween. Thus, efficient layout of the first and second pressing members 131R and 131L and the belt unit 30 can be ensured.

(12) As illustrated in FIG. 3, the belt unit 30 includes the intermediate transfer belt 34, and the transfer surface 34A of the intermediate transfer belt 34 is configured to contact the photosensitive drums 18. Further, the abutment surface 131A of the first pressing member 131R and abutment surface 131A of the second pressing member 131L are configured to contact the process cartridges 14. The abutment surface 131A of the first pressing member 131R and abutment surface 131A of the second pressing member 131L are disposed below the transfer surface 34A of the intermediate transfer belt 34, that is, disposed at the process cartridge 14 side relative to the transfer surface 34A so as to be closer to the exposure unit 11 than the transfer surface 34A is to the exposure unit 11. As a result, when the first pressing member 131R is situated at the abutment position, the abutment surface 131A thereof can be made to reliably abut against the process cartridge 14, particularly, the first pressing unit 57R, and when the second pressing member 131L is situated at the abutment position, the abutment surface 131A thereof can be made to reliably abut against the process cartridge 14, particularly, the second pressing unit 57L.

(13) The process cartridge 14 is disposed above the exposure unit 11 as illustrated in FIG. 1, and the first and second positioning members 89R and 89L are disposed below the photosensitive drum 18 as illustrated in FIG. 3. Thus, when the first and second pressing members 131R and 131L are situated at the abutment position, the first flange 20R of the photosensitive drum 18 and first positioning member 89R can be reliably engaged with each other through the engagement part 52 by a weight of the process cartridge 14, and the second flange 20L of the photosensitive drum 18 and the second positioning member 89L can be reliably engaged with each other through the engagement part 52 by the weight of the process cartridge 14.

(14) As illustrated in FIGS. 5 and 10, the front cover 6 and the first and second pressing members 131R and 131L interlock with each other. Thus, when the front cover 6 is situated at the closed position, the first and second pressing members 131R and 131L can be reliably disposed at the abutment position, while when the front cover 6 is situated at the open position, the first and second pressing members 131R and 131L can be reliably disposed at the abutment release position.

(15) As illustrated in FIG. 3, the first positioning member 89R and the exposure unit 11 are connected with each other, and the second positioning member 89L and the exposure unit 11 are connected with each other. Thus, positioning accuracy between the first positioning member 89R and exposure unit 11 can be reliably improved, and positioning accuracy between the second positioning member 89L and the exposure unit 11 can be reliably improved. As a result, positioning accuracy between the photosensitive drum 18 and the exposure unit 11 can be reliably improved.

(16) As illustrated in FIG. 4, the first and second positioning members 89R and 89L each have the positioning concave parts 93.

Thus, when the first pressing member 131R is situated at the abutment position, the positioning concave parts 93 of the first positioning member 89R can each receive, through the engagement part 52, the first flange 20R of the photosensitive drum 18, while when the second pressing member 131L is situated at the abutment position, the positioning concave parts 93 of the second positioning member 89L can each receive, through the engagement part 52, the second flange 20L of the photosensitive drum 18.

11. Second Embodiment

Figure 13:
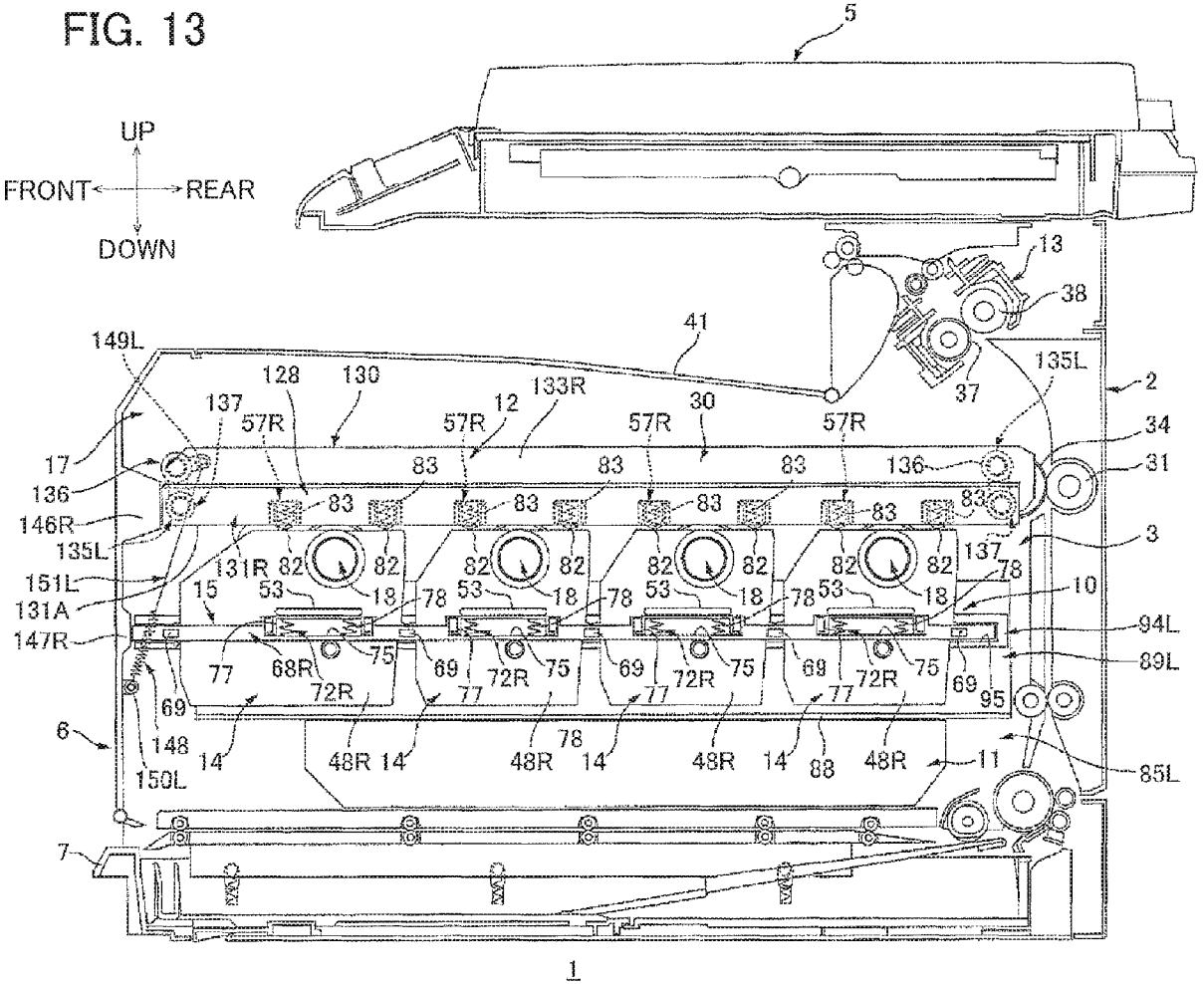
FIG. 13 is a cross-sectional side view of an image forming apparatus according to a second embodiment, and taken along a line corresponding to the line B-B of FIG. 4 and showing a state where a front cover is at its closed position.
Figure 14:
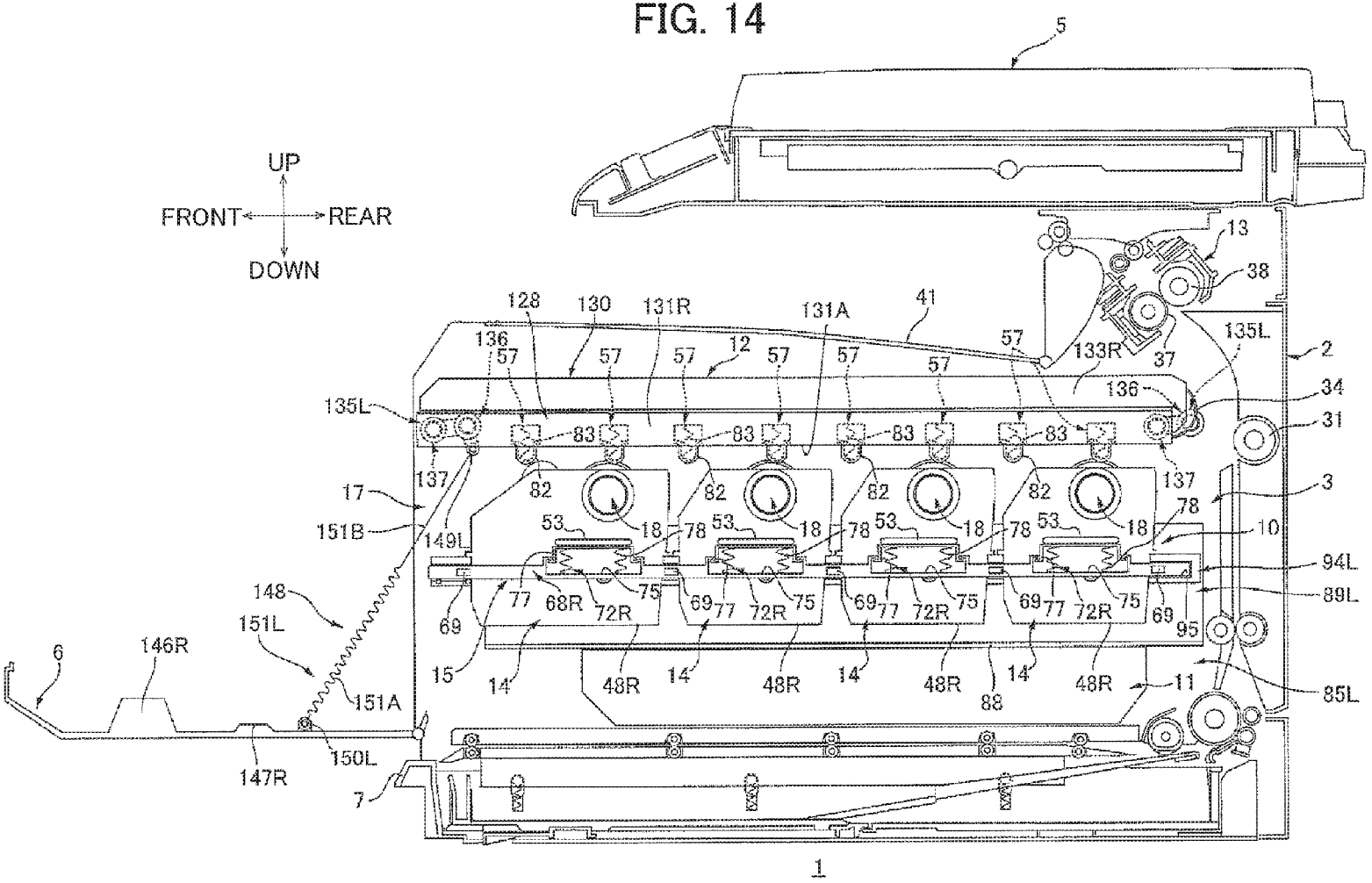
FIG. 14 is a cross-sectional side view of the image forming apparatus according to the second embodiment, and taken along a line corresponding to the line B-B of FIG. 4 and showing a state where the front cover is at its open position.

With reference to FIGS. 13 and 14, an image forming apparatus according to a second embodiment will be described. In the second embodiment, the same reference numerals are given to the same or similar components as those in the first embodiment and the description thereof will be omitted.

In the image forming apparatus 1 of the above first embodiment, each process cartridge 14 includes the first and second pressing units 57R and 57L, as illustrated in FIG. 5.

On the other hand, as illustrated in FIG. 13, in the image forming apparatus according to the second embodiment, the first pressing member 131R includes the first pressing units 57R, and the second pressing member 131L includes the second pressing units 57L.

The first pressing unit 57R of this second embodiment is supported by the first pressing member 131R with the top and bottom thereof being opposite to those of the first pressing unit 57R of the first embodiment. Similarly, the second pressing unit 57L of this second embodiment is supported by the second pressing member 131L with the top and bottom thereof being opposite to those of the second pressing unit 57L of the first embodiment.

More specifically, in the second embodiment, the first pressing unit 57R has a configuration in which the two abutted parts 82 are biased downward by the two biasing members 83. The two abutted parts 82 can be moved in the vertical direction between an advanced position (see FIG. 14) at which the abutted parts 82 advance downward and a retracted position (see FIG. 13) at which the abutted parts 82 retracted upward. The second pressing unit 57L has the same configuration as that of the first pressing unit 57R.

As illustrated in FIG. 13, in the second embodiment, when the first pressing member 131R is situated at the abutment position, the abutment surface 131A of the first pressing member 131R is disposed, slightly spaced apart from an upper end edge of the first side wall 48R of the process cartridge 14. The front one of the two abutted parts 82 in the first pressing unit 57R is abutted on a front end portion of the upper end edge of the first side wall 48R from above, and the rear one of the two abutted parts 82 in the first pressing unit 57R is abutted on a rear end portion of the upper end edge of the first side wall 48R from above. The second pressing unit 57L operates in the same manner as the first pressing unit 57R.

As a result, the first and second pressing units 57R and 57L press the process cartridge 14 downward against the biasing force of the first and second biasing parts 72R and 72L to situate the process cartridge 14 at the engagement position.

On the other hand, as illustrated in FIG. 14, when the first pressing member 131R is situated at the abutment release position, the two abutted parts 82 of the first pressing unit 57R are separated from the upper end edge of the first side wall 48R in the upper front direction. Further, when the second pressing member 131L is situated at the abutment release position, the two abutted parts 82 of the second pressing unit 57L are separated from the upper end edge of the second side wall 48L in the upper front direction.

Thus, the process cartridge 14 is biased upward by the biasing force of the first and second biasing parts 72R and 72L so as to be situated at the engagement release position.

As a result, also in the second embodiment, the same functions and advantages as those in the first embodiment can be obtained.

12. Modifications

In the above first and second embodiments, the process cartridge 14 integrally includes the photosensitive drum 18 and the developing unit 29. However, the process cartridge may be modified to include a drum unit having the photosensitive drum and a developing unit detachably attached to the drum unit.

According to this modification, the same functions and advantages as those in the first and second embodiments can be obtained. The first embodiment, the second embodiment, and the modification can be appropriately combined with one another.

The leftward/rightward direction is an example of an axial direction, the vertical direction is an example of a first direction, and the forward/rearward direction is an example of a sliding direction.

While the description has been made in detail with reference to specific embodiments thereof, it would be apparent to those skilled in the art that various changes and modifications may be made therein without departing from the spirit and scope of the above described embodiments.

What is claimed is:

1. An image forming apparatus comprising:

a main casing;

a process cartridge including a photosensitive drum;

a belt unit including a belt and configured to move between a contact position, at which the belt contacts the photosensitive drum, and a separated position, at which the belt is separate from the photosensitive drum;

a drawer configured to support the process cartridge and move in a sliding direction between an internal position inside of the main casing and an external position outside of the main casing, the sliding direction being perpendicular to an axial direction of the photosensitive drum;

an exposure unit configured to expose the photosensitive drum to light, the exposure unit being disposed such that when the drawer supporting the process cartridge is in the internal position, the belt unit, the process cartridge, and the exposure unit are arranged in this order in a first direction such that the belt unit is positioned at an upstream side of the process cartridge in the first direction and the exposure unit is positioned at a downstream side of the process cartridge in the first direction;

a positioning member configured such that the photosensitive drum is engaged to the positioning member from an upstream side of the positioning member in the first direction so as to be positioned by the positioning member; and a pressing member configured to press the process cartridge from the upstream side toward the downstream side of the process cartridge in the first direction so as to position the photosensitive drum relative to the positioning member, the pressing member being configured to move between a first position, at which the pressing member presses the process cartridge, and a second position, at which pressing of the pressing member to the process cartridge is released.

2. The image forming apparatus according to claim 1, wherein the process cartridge is configured such that in a state that the process cartridge is supported by the drawer, the process cartridge moves between an engagement position, at which the photosensitive drum and the positioning member are engaged with each other, and an engagement release position, at which engagement between the photosensitive drum and the positioning member is released, the process cartridge is at the engagement position when the pressing member is at the first position, and the process cartridge is at the engagement release position when the pressing member is at the second position.

3. The image forming apparatus according to claim 2, further comprising a biasing part configured to bias the process cartridge from the engagement position toward the engagement release position.

4. The image forming apparatus according to claim 3, wherein the biasing part is provided to the drawer.

5. The image forming apparatus according to claim 3, wherein the biasing part comprises:

a contact part configured to contact the process cartridge so as to move the process cartridge between the engagement position and the engagement release position; and a restricting part configured to restrict movement of the contact part such that a moving amount, by which the contact part moves when the contact part moves the process cartridge from the engagement position to the engagement release position, is constant in the sliding direction.

6. The image forming apparatus according to claim 2, wherein the process cartridge comprises a pressing unit configured to be pressed by the pressing member, the pressing unit comprises:

an abutted part configured to be abutted by the pressing member; and a biasing member configured such that when the abutted part is abutted by the pressing member, the biasing member biases the photosensitive drum toward the positioning member, the abutted part being configured to move in a direction parallel to the first direction between an advanced position and a retracted position, the retracted position being closer to the exposure unit than the advanced position is to the exposure unit.

7. The image forming apparatus according to claim 6, wherein in a direction parallel to the first direction, a moving amount of the pressing member from the first position to the second position is greater than a sum of a moving amount of the process cartridge from the engagement position to the engagement release position and a moving amount of the abutted part from the retracted position to the advanced position.

8. The image forming apparatus according to claim 6, wherein the pressing unit includes two pressed parts that are disposed spaced apart from each other in the sliding direction so as to sandwich the photosensitive drum therebetween as viewed in the axial direction of the photosensitive drum, each pressed part comprises:

the abutted part; and the biasing member.

9. The image forming apparatus according to claim 1, wherein the pressing member moves from the first position to the second position, as being interlocked with movement of the belt unit from the contact position to the separated position, and moves from the second position to the first position, as being interlocked with movement of the belt unit from the separated position to the contact position.

10. The image forming apparatus according to claim 9, wherein the belt unit comprises a frame configured to support the belt, the pressing member being connected with the frame.

11. The image forming apparatus according to claim 1, wherein the pressing member and the belt unit are arranged in the axial direction of the photosensitive drum.

12. The image forming apparatus according to claim 1, wherein the belt has a transfer surface configured to contact the photosensitive drum, the pressing member has an abutment surface configured to contact the process cartridge, and the abutment surface of the pressing member is positioned closer to the exposure unit than the transfer surface of the belt is to the exposure unit.

13. The image forming apparatus according to claim 1, wherein the process cartridge is disposed below the belt unit.

14. The image forming apparatus according to claim 1, wherein the main casing is formed with an opening such that the process cartridge is capable of passing therethrough, the main casing is provided with a cover configured to move between an open position, at which the cover opens the opening, and a closed position, at which the cover closes the opening, the pressing member moves from the first position to the second position as being interlocked with movement of the cover from the closed position to the open position, and moves from the second position to the first position as being interlocked with movement of the cover from the open position to the closed position.

15. The image forming apparatus according to claim 1, wherein the positioning member and the exposure unit are connected with each other.

16. The image forming apparatus according to claim 1, wherein the positioning member includes a concave part that is recessed from an upstream side to a downstream side in the first direction and is configured to receive the photosensitive drum therein.

17. An image forming apparatus comprising:

a main casing;

a process cartridge including a photosensitive drum;

a drawer configured to support the process cartridge, the drawer being configured to move between an internal position inside of the main casing and an external position outside of the main casing;

a belt configured to move between a contact position where the belt contacts the photosensitive drum when the drawer supporting the process cartridge is positioned in the internal position and a separated position where the belt is separated from the photosensitive drum when the drawer supporting the process cartridge is positioned in the internal position, the photosensitive drum being positioned below the belt when the drawer supporting the process cartridge is positioned in the internal position;

an exposure unit configured to expose the photosensitive drum to light, the exposure unit being positioned below the photosensitive drum when the drawer supporting the process cartridge is positioned in the internal position;

a positioning member configured to position the photosensitive drum in the main casing, the positioning member being positioned below the photosensitive drum when the drawer supporting the process cartridge is positioned in the internal position;

a first pressing member configured to press the process cartridge to the positioning member; and a second pressing member configured to press the process cartridge to the positioning member, wherein the belt is positioned between the first pressing member and the second pressing member.

18. The image forming apparatus according to claim 17, wherein the first pressing member is configured to move between a first position where the first pressing member presses the process cartridge and a second position where pressing of the first pressing member is released, and wherein the second pressing member is configured to move between a third position where the second pressing member presses the process cartridge and a fourth position where pressing of the second pressing member is released.

19. The image forming apparatus according to claim 18, wherein the first pressing member moves from the first position to the second position in accordance with movement of the belt from the contact position to the separated position, and wherein the second pressing member moves from the third position to the fourth position in accordance with movement of the belt from the contact position to the separated position.

20. The image forming apparatus according to claim 17, further comprising a frame configured to support the belt, the first pressing member and the second pressing member being connected with the frame.

21. The image forming apparatus according to claim 17, wherein the positioning member includes a first plate and a second plate, the exposure unit being positioned between the first plate and the second plate, the first pressing member being configured to press the process cartridge to the first plate and the second pressing member being configured to press the process cartridge to the second plate.

22. The image forming apparatus according to claim 17, wherein the positioning member is configured to contact the photosensitive drum.

* * * * *